US006953014B2

(12) United States Patent
Folino

(10) Patent No.: US 6,953,014 B2
(45) Date of Patent: Oct. 11, 2005

(54) THERMAL COMPENSATING DESMODROMIC VALVE ACTUATION SYSTEM

(76) Inventor: Frank A. Folino, 17 Indian Hill La., Salem, MA (US) 13827

( * ) Notice: Subject to any disclaimer, the term of this patent is extended or adjusted under 35 U.S.C. 154(b) by 26 days.

(21) Appl. No.: 10/663,965

(22) Filed: Sep. 16, 2003

(65) Prior Publication Data

US 2004/0055552 A1 Mar. 25, 2004

Related U.S. Application Data

(63) Continuation-in-part of application No. 10/099,117, filed on Mar. 15, 2002, now Pat. No. 6,619,250.
(60) Provisional application No. 60/276,889, filed on Mar. 16, 2001.

(51) Int. Cl.[7] ..... F01L 1/30
(52) U.S. Cl. ..... 123/90.24; 123/90.16; 123/90.15; 123/90.25; 123/90.26; 74/55
(58) Field of Search ..... 123/90.15–90.18, 123/90.24–90.26, 90.39–90.47, 90.19; 74/53–55

(56) References Cited

U.S. PATENT DOCUMENTS

| | | | |
|---|---|---|---|
| 577,589 A | 2/1897 | Teubert | |
| 1,309,339 A | 7/1919 | Reynolds | |
| 1,561,544 A | 11/1925 | How | |
| 1,679,794 A | 8/1928 | Smith | |
| 2,466,550 A | 4/1949 | Lundquist | |
| 2,584,055 A | 1/1952 | Smith | |
| 2,641,236 A | 6/1953 | Mansfield | |
| 2,738,748 A | 3/1956 | Hecht | |
| 2,823,655 A | 2/1958 | Repko | |
| 2,954,017 A | 9/1960 | Forstner | |
| 3,020,018 A | 2/1962 | Stram | |
| 3,195,528 A | 7/1965 | Franklin | |
| 3,317,179 A | 5/1967 | Willis | |
| 3,424,024 A | 1/1969 | Derbfuss | |
| 3,585,974 A | 6/1971 | Weber | 123/90.12 |

(Continued)

FOREIGN PATENT DOCUMENTS

| | | | |
|---|---|---|---|
| DE | 3804333 A1 | 8/1989 | F01L/1/02 |
| DE | 3841839 A | 6/1990 | F01L/1/30 |
| EP | 91804 A1 | 10/1983 | F01L/1/30 |
| FR | 2467971 A | 5/1981 | F01L/1/04 |
| JP | 03168307 A | 7/1991 | F01L/1/30 |

OTHER PUBLICATIONS

"What does desmo mean?", Desmodromic Valve Gear; http://www.usq.edu.au/users/grantd/mcycle/desmo.htm; Nov. 23, 2001.

*Primary Examiner*—Thomas Denion
*Assistant Examiner*—Jaime Corrigan
(74) *Attorney, Agent, or Firm*—Perkins Smith & Cohen LLP; Jacob N. Erlich; Peter J. Borghetti

(57) ABSTRACT

A thermal compensating desmodromic valve actuation system for opening and closing at least one valve of an engine having a cam assemblage and a driving mechanism for reciprocal movement operably connected to said cam assemblage. The cam assemblage includes a cam mechanism for rotational movement and the driving mechanism also being operably connected to the at least one valve of the engine to move the at least one valve between a valve closed position and a valve open position and between the open position and the closed position in a manner directly related to the rotational movement of the cam mechanism. In addition, mechanisms are provided for adjustably controlling the movement of the at least one valve in order to provide a variable amount of opening of the at least one valve in the open position, and for compensating for the thermal conditions of the engine causes valve stem elongation and contraction. The opening and closing of the at least one valve takes place without the intervention of a spring action.

9 Claims, 16 Drawing Sheets

U.S. PATENT DOCUMENTS

| | | | | |
|---|---|---|---|---|
| 3,641,988 | A | | 2/1972 | Torazza et al. ..... 123/90.16 |
| 3,684,237 | A | | 8/1972 | Hyde et al. ..... 251/58 |
| 3,911,879 | A | | 10/1975 | Altmann ..... 123/90.16 |
| 3,952,995 | A | | 4/1976 | Nagumo et al. ..... 251/232 |
| 4,061,115 | A | | 12/1977 | Predhome, Jr. ..... 123/90.16 |
| 4,158,367 | A | | 6/1979 | Mailliet ..... 137/340 |
| RE30,188 | E | | 1/1980 | Predhome, Jr. ..... 123/90.16 |
| 4,190,074 | A | | 2/1980 | Mailliet et al. ..... 137/315 |
| 4,457,268 | A | | 7/1984 | Jones ..... 123/90.23 |
| 4,514,129 | A | | 4/1985 | Legille et al. ..... 414/200 |
| 4,570,900 | A | | 2/1986 | Lonardi et al. ..... 251/58 |
| 4,671,221 | A | | 6/1987 | Geringer et al. ..... 123/90.16 |
| 4,674,451 | A | | 6/1987 | Rembold et al. ..... 123/90.16 |
| 4,763,615 | A | | 8/1988 | Frost ..... 123/90.25 |
| 4,805,568 | A | | 2/1989 | Springer et al. ..... 123/188 GC |
| 4,858,573 | A | | 8/1989 | Bothwell ..... 123/90.15 |
| 4,898,130 | A | | 2/1990 | Parsons ..... 123/90.16 |
| 5,016,581 | A | | 5/1991 | Parsons ..... 123/90.25 |
| 5,127,375 | A | | 7/1992 | Bowman et al. ..... 123/90.12 |
| 5,782,216 | A | | 7/1998 | Haas et al. ..... 123/90.16 |
| 5,809,951 | A | | 9/1998 | Kim ..... 123/90.16 |
| 6,000,375 | A | * | 12/1999 | Isobe ..... 123/322 |
| 6,311,659 | B1 | | 11/2001 | Pierik ..... 123/90.24 |
| 6,550,435 | B1 | * | 4/2003 | Zubeck ..... 123/90.16 |
| 6,619,250 | B2 | | 9/2003 | Folino ..... 123/90.16 |

* cited by examiner

TOP VIEW

0 DEG 22.5 DEG

45 DEG

FIG. 8D
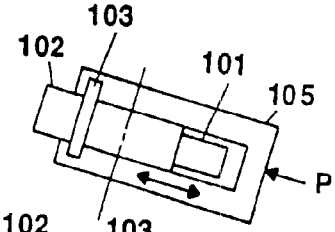
FIG. 8C
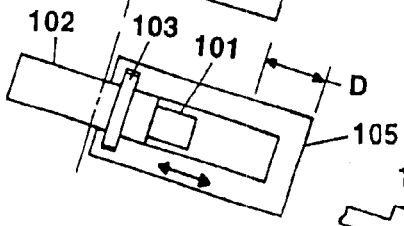
FIG. 8B
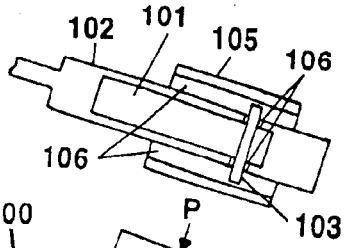
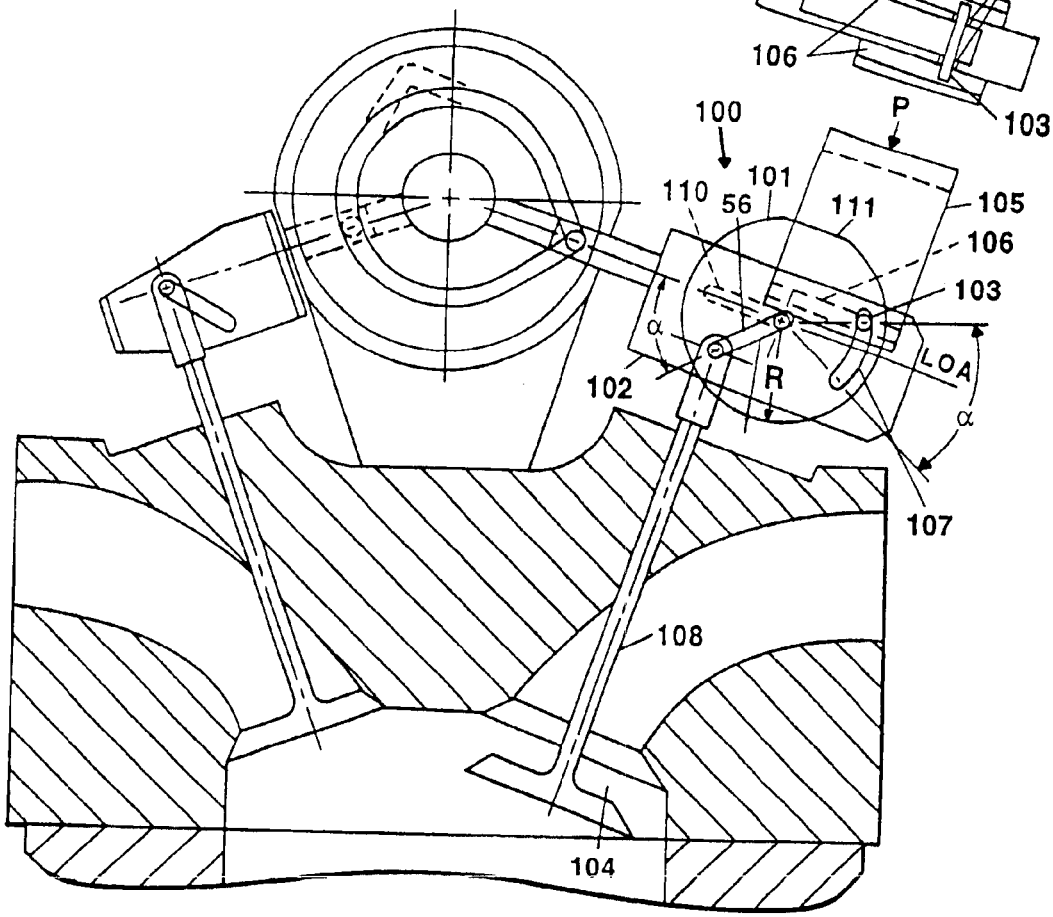
FIG. 8A

THERMAL COMPENSATING DESMODROMIC VALVE ACTUATION SYSTEM

CROSS REFERENCE TO RELATED APPLICATIONS

The present application is a Continuation-In-Part of utility application Ser. No. 10/099,117, entitled DESMODROMIC VALVE ACTUATION SYSTEM filed Mar. 15, 2002, now U.S. Pat. No. 6,619,250, issued Sep. 16, 2003, which claims benefit of Provisional Application Ser. No. 60/276,889 entitled VALVE ACTUATION SYSTEM filed Mar. 16, 2001, and the entire contents of all of these applications are incorporated herein by reference.

BACKGROUND OF THE INVENTION

The present invention relates to valve action in relation to an internal conbustion engine in automobiles and, more particularly, to a desmodromic valve actuation system for intake and exhaust function of a four-stroke piston in such engines.

Valve action of internal combustion engines is required to control the piston chamber for four functions of intake, compression, combustion and exhaust. The proper timing for opening and closing these valves is extremely critical to effectively and efficiently produce the horsepower for an internal combustion engines. The standard method of controlling and operating these cams is initiated by a timing belt that connects the engine crankshaft to a camshaft. The camshaft has a series of cams, one for each intake and exhaust valve in each cylinder. The cams, as presently configured in all four cycle engines, are designed to displace the valve inwardly to open either the intake port or the exhaust port. The cams are incapable of closing the port openings; and, accordingly, springs, that are compressed when the cams open a port, are energized to provide forces that close the port. The energy merely supplies the force to return the valve to closed position when the energy is released, but the cam provides control of the valve. This control is necessary so that acceleration/deceleration of the valve can be accomplished with minimum impact loading of the valve seat and hence minimize noise. Further, the frequency of cycles for opening and closing of the valve is quite high requiring very high spring loading to accelerate the mass of the valve.

The four-cycle internal combustion engine requires a first cycle that is the intake wherein a mixture of gas and air enters an opened valve intake port. The piston is displaced vertically down the piston cylinder by the engine crankshaft. The second cycle is compression of the gas/air mixture. The piston is driven up the cylinder by the crankshaft. Both intake and exhaust valves are in a closed position to effectively seal the piston cavity and allow the pressurization of the gas/air mixture. At the appropriate time a spark is introduced to the mixture and an explosion occurs with rapid expansion of the resulting gases. The piston is driven down by the force of the expanding gas which in turn applies a resultant torque to the crankshaft. This torque when combined with a sequence of these explosions at additional pistons will result in the rotational energy of the engine and in its output horsepower. The final cycle is the return up the cylinder by the piston wherein the exhaust valve port is opened and allows gases to escape. At the conclusion of this cycle the next series of cycles is ready to commence by the intake cycle. It can be seen that the valve's closing and opening are essential in the process along with their control in the speed of their action and the duration they remain closed. It is desirable to operate these valves at the highest speed possible for effective and efficient power generation.

The opening of the valves by the camshaft is a positive mechanical operation by the individual cams. The closing of the valve is a kinematic action resulting from the energy stored in the spring to return and close the valve. This complete function severely limits the speed at which the engine can run, as the valve mass inertia is critical for the stored energy of the spring and limits the cycle time. The acceleration and deceleration of the cam for high cycling conditions can severely limit the size of the spring.

The normal function in the automobile engine is such that there is a firing sequence for the cyclinders that are constantly repeatable regardless of whether the car is parked or moving at any speed. Accordingly, the same displacement of gas/air mixture is constantly used regardless of speed or stopped. It can be seen that, when stopped, the engine uses much more gas than necessary, when all that is required is to keep the engine running can be accomplished with very minimal amounts of air/gasoline mixture. Power is required for accelerating a vehicle which requires richer mixtures and higher speeds of the engine. If the valves can be controlled during acceleration, efficient and effective volumes of mixture can be ingested in the cylinder for the appropriate condition of speed, thereby offering fuel economy. Finally, when achieving a desired speed it is only necessary to overcome the wind drag forces, the friction of the wheels on the road and the internal friction of the drive train and engine inertia to maintain the velocity. This can be accomplished with less than the total displacement put out by the engine. It would be desirable for effective gas consumption to have the ability to not only control the amount of air/gas mixture entering each piston but also have the ability to close any number of cylinders while the engine is performing with the remaining operational cylinders. Of necessity, the timing is critical for the closing down and reopening of the selected cylinders that become inoperative.

It is, therefore, the object of the present invention to provide means that will significantly reduce gas consumption of an internal combustion engine as typically found in an automobile by efficiently and effectively controlling valve port openness in concert with the requirements of the operation of a vehicle.

It is yet another object of the invention to present the means by which valve control is simple, precise and timely, which in turn will be in concert with the engine performance and results in immediate smooth sensitive control of the engine performance and in turn the automobile.

It is an additional object of the invention to provide the means for the necessary timing of the valve in a piston to be in sequence and in position relative to port opening and closing as well as acceleration and deceleration requirements of the valve.

It is also an object of the invention to present the means by which piston firing sequences and individual operations will be designed and controlled.

It is a further object of the present invention to provide a valve control system that is simplified in nature but more effective in controlling the percentage opening of valve ports and will completely eliminate the necessity of springs in the functioning of valves as found in present-day automotive internal combustion engines.

It is another object of the invention to provide a valve actuation system that will be considerably amenable to higher engine speed performance, enhancing the engine performance with resulting savings of gasoline.

It is a further object of the present invention to provide a simple robust construction of a valve actuator that is simple in operation and precisely controlled at all times.

It is a further object of the present invention to compensate for the thermal expansion and contraction of the valve stem during varying operating and ambient conditions to improve valve sealing.

SUMMARY OF THE INVENTION

These and other objects are well met by the presently disclosed effective, highly efficient, essentially springless (desmodromic) and substantially infinitely variable valve actuator system of this invention for use with, for example, an internal combustion engine. In one aspect of the invention a first action of a linearly reciprocating actuation system by a rotating cam and translating means interacts with a second controllable actuating means that controls valve position, and will be substantially infinitely variable in displacement thereby controlling the percentage of port opening in each piston separately or in unison. Any percentage opening of the valve port is achievable to the extent that the valve port can be closed indefinitely all the while the engine is performing under the influence of the remaining operating pistons. All the control exercised on the valves are performed easily, quickly and in total concert with the continuous smooth operation of the engine. All these functions can be computer controlled as a function of vehicle performance and will not affect the smoothness of operation of the internal combustion engine and in turn the vehicle itself.

In an embodiment of the invention, a reciprocating cam translating device is coupled to a rotary cam which receives an input from, for example, a pulley driven by a timing belt from an output shaft of an internal combustion engine. A second device, under controlled conditions, converts the reciprocating linear motion at the reciprocating cam translating device into a substantially infinitely variable reciprocating motion, which, in fact, is the valve itself. The rotary cam having a grooved track in a circular flat disk, with appropriate configuration, displaces a translating means which is a ball constrained in a slide which, in turn, reciprocates in a slot to achieve the first reciprocating linear movement. Attached to the slide is an assembly that contains a rotable link in which a slot of appropriate length and juxtaposition such that as the assemblage translates in accordance to the reciprocation of the first device along its line of action the slot presents an angle to that line. Pins affixed to the valve will ride in the slot and the valve, fixed in the engine block will move up and down as the slot reciprocates in accordance with the first cam/translating means. The up and down movement of the valve is dependent on the angle the slot makes with the line of action of the first translating means. A repeatable fixed point in the slot is required no matter what the angle is and as it will repeatably define the closed position of the valve regardless of how much opening of the port is required. If the link is rotated to where the centerline is co-axial with the line of action the valve has closed the port and will remain closed while the engine is still performing. Rotation of the link is performed by an adjustable member which has a slot parallel to the line of action that allows a pin, which rotates the link to any angle, to slide along the line of action and at the same time secures the angular position of the slot. This adjustable slide must move normal to the line of action in a housing affixed to the engine block. Control of the adjustable slide by an actuator, electro-mechanical or hydraulic, with position information of the slide will effectively control rotation of the link and in turn the amount of port opening.

The cam groove curvatures are shown such that the proper rise and fall along with dwell time are in concert with the engine. The rise and fall cam curvature can be of any variation—linear, spiral, sinusoidal or desired algebraic polynominal. Curvatures ideally should be such that significant effort should be exercised to use as long a time as possible to decelerate and land the valve as easily as possible to reduce landing click.

In another aspect of the invention computer control of each valve allows operation of any set of pistons such that for, preferably, an eight cylinder engine 2, 4, 6 or 8 pistons (although the invention is not limited to a specific number of cylinders) could be operating at any time while those that are operating have the further enhancement of variable valve displacement. Under the most economic conditions while stopped six cylinders could be non-functional while two cylinders with minimal valve openings would be sufficient to keep the motor running. Under computer control while accelerating, the required number of pistons and valve opening percentages will be functioning. At the required cruising speed the minimal number of pistons and most economical valve port opening will be in effect. There are any number of variations on how to control these valves. One controller could control all the valves at once with no ability to turn off any piston. Two controllers where one controls two pistons and the other controls four pistons. This gives the option of two, four or six pistons working. The ideal would be one controller for each cylinder.

In yet another aspect of the invention is the insertion of a valve stem thermal compensator having pair of distally opposed spring-like projections into the slotted cam to adjust for the thermal expansion or contraction of the valve stem.

For a better understanding of the present invention, together with other and further objects thereof, reference is made to the accompanying drawings and detailed description and its scope will be pointed out in the appended claims.

BRIEF DESCRIPTION OF THE DRAWINGS

FIGS. 8A–8D illustrate the basic control function of the valve assemblies of this invention;

DETAILED DESCRIPTION OF PREFERRED EMBODIMENT

Figure 1B:
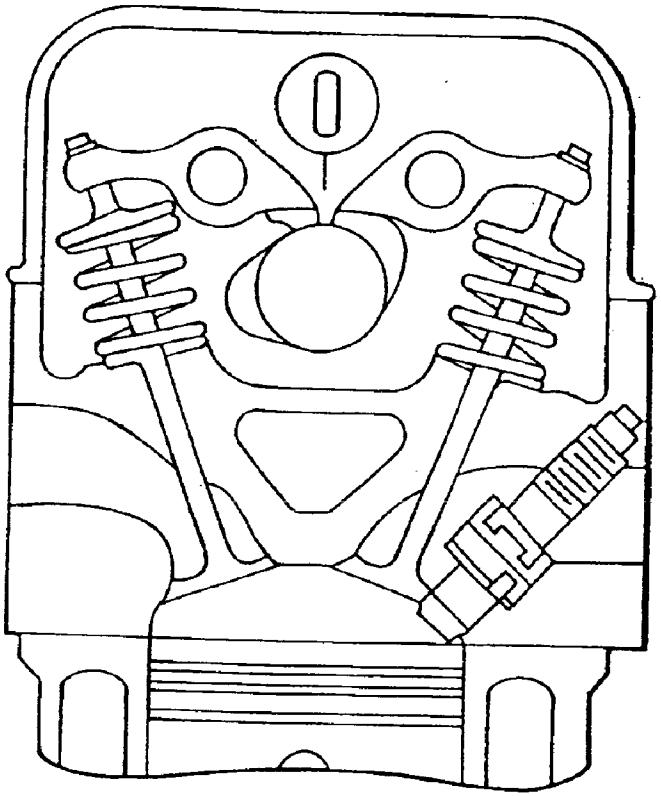
FIG. 1B (PRIOR ART)
FIG. 1B represents a partial, cross-sectional view of an embodiment of a valve system of the prior art.
Figure 1A:
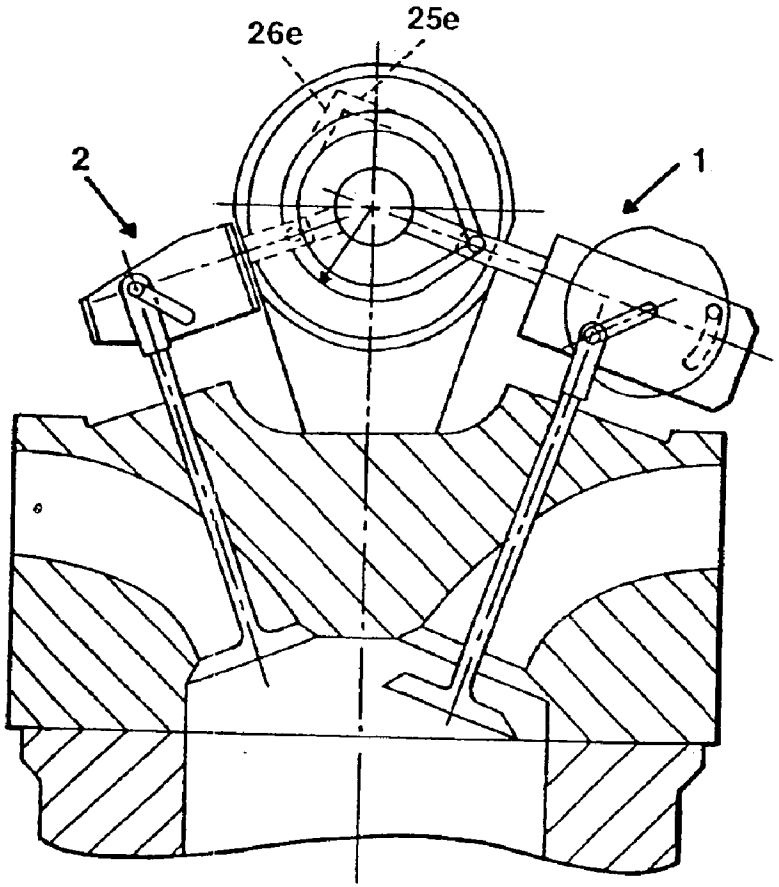
FIG. 1A represents a partial, cross-sectional view of an embodiment of the valve system of this invention.

One embodiment of the present invention is shown in FIG. 1A. As illustrated, the elements of this variable, desmodromic, valve actuation system of this invention are configured in juxtaposition for intake and exhaust valves 1 and 2, respectively, as they would interact with a single piston of a four-cycle internal combustion engine. By way of comparison the present prior art cam/spring valve actuation is shown in FIG. 1B. The benefits derived from a variable valve actuation capability are well known and chronicled in the automotive market. The object here is to present a substantially infinitely variable actuation system that can be precisely controlled to present the most advantageous configuration of valving including any percentage port opening on the intake cycle to closure of the intake port and resulting benign piston performance. The ability to perform these functions reliably and precisely while the engine is operational will be shown. This highly sensitive system, under computer control, and while the vehicle is traveling will effectively and efficiently consume gasoline and maximize engine performance. The description and kinematics of this substantially infinitely variable, desmodromic, valve actuation system of the present invention follows.

Figure 2A:
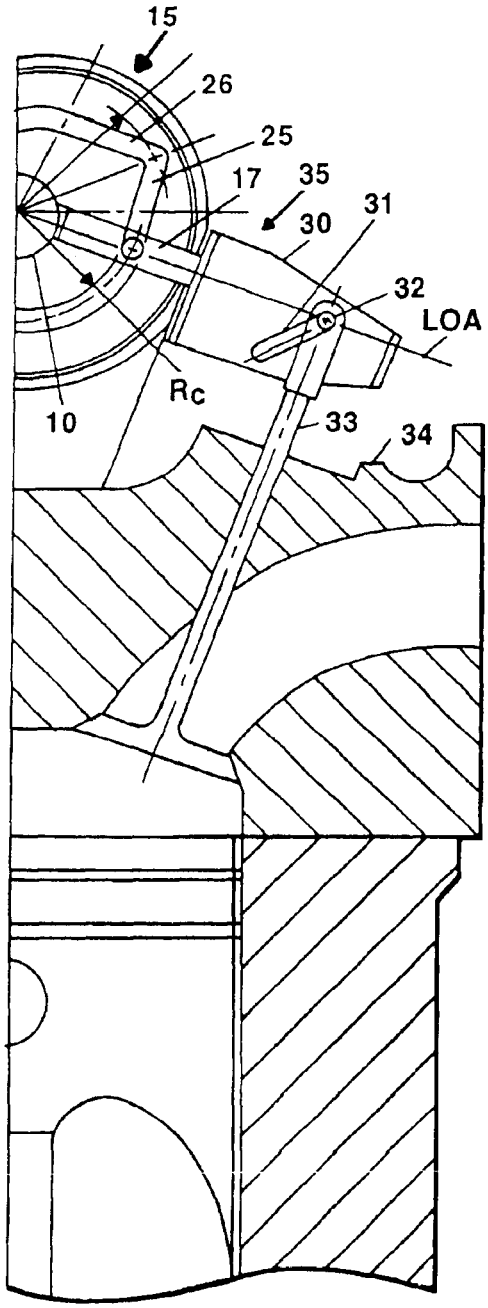
FIG. 2A represents a partial, cross-sectional view of a close valve position of the valve system of this invention.
Figure 2B:
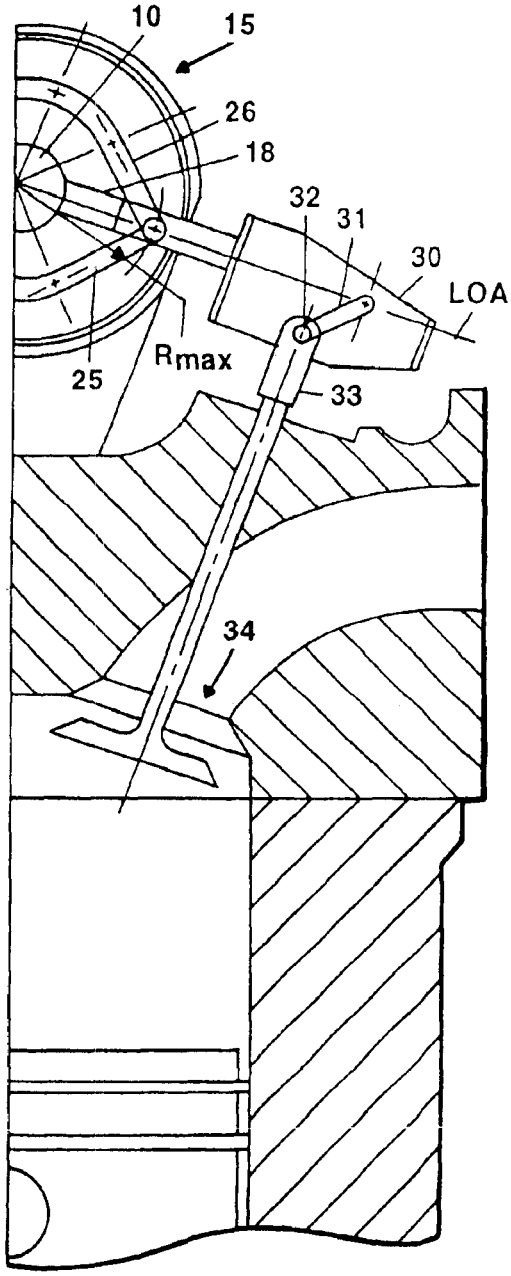
FIG. 2B represents a partial, cross-sectional view of an open valve position of the valve system of this invention.

In FIGS. 2A and 2B, a standard piston arrangement with the valve actuation system of the present invention is shown. As illustrated, the present invention eliminates the cam and spring method of valving with a essentially springless (desmodromic) kinematic system that positively controls the valve cycling and requires no springs. This is of considerable advantage, as the springs must be compressed to as much as 65 to 85 pounds depending on size and displacement of an engine. This large force is necessary to accelerate the valves at the high cyclic rates of an engine, as high as 6,000 to 7,0000 revolutions per minute (RPM). A considerable amount of energy is used just to deflect the springs rather than applying it to the engine crankshaft. The present invention will require considerably less, as the mass inertia of the valve system will be less and the kinematics of the valve actuation will be more effective. It will be possible with the present invention to run the engine at higher speeds which is a further enhancement to engine performance.

The basic principal in the operation of an internal combustion engine is the requirement of the proper timing of opening and closing the valves for the 4 cycles of each piston. Once the engine crankshaft starts to rotate, the relationship between it and the camshaft is established and the configuration of cams on the camshaft controls the timing of opening and closing the intake and exhaust valves. The standard automobile engine, using the cam/spring valve actuator system of FIG. 1B presents a repetitive, non-variable valve port opening which is inefficient for maximum engine performance and gasoline consumption. The basic kinematics of valve actuation in accordance with the present invention as shown in FIG. 1A will be described and will be further developed to introduce the variable aspect of valve actuation which is the preferred embodiment of the present invention.

Figure 3C:
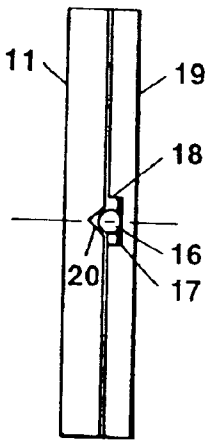
FIGS. 3A–3F illustrate the kinematics of the valve system of this invention.

FIGS. 2A and 2B illustrate closed and opened positions of a valve 33 in a cylinder 34 in accordance with the embodiments of the present invention. As the camshaft 10 rotates in a clockwise direction, in concert and at half speed of the crankshaft, the input cam 11 initiates a reciprocating motion via the cam assemblage 15. FIGS. 3A and 3B illustrate in detail the kinematics of the cam assemblage 15. In FIG. 3A input cam rise 25 is shown in the initial condition of the cam groove or track 20 and a ball 16 at the minimum Rc radius. As the input cam rotates in a clockwise direction, the ball 16 which is captured in a slide or drive link 17 is radially displaced to a maximum position D at Rmax by the rise cycle 26 which is shown in FIG. 3B. The slide is contained in the guideway 18 of the non-rotating backing plate 19 as shown in FIG. 3C. As the input cam continues to rotate the ball and slide are displaced inwardly along the guideway 18 by the full cycle 25 of the cam track 20. This 90- degree rotation of the input cam will result in reciprocating the slide 17 back and forth in the guideway and establish a line of action (LOA) of the slide. As this input cam continues to rotate the remaining 270 degrees in FIG. 3E, the ball and slide will not be displaced as the cam track 26 will present a circular groove and thereby a constant radius Rc. This, in effect, results in a dwell period for the slide and no reciprocating motion will be in effect. The action described for 360 degrees rotation of the camshaft reflects the four cycles of either the intake or exhaust valve actions. The valve is opened and closed by the rise and fall cycle and for the 270 degrees for the intake valve compression, combustion and exhaust occur requiring the intake valve to remain closed for that period as the 270 degrees dwell will affect. For the exhaust valve, the action is offset 90 degrees as shown in FIG. 3F. Rise cycle 25*e*, dotted, and fall cycle 26*e* of the exhaust valve precede rise cycle 25*i* and fall cycle 26*i* of the intake cycle as the camshaft rotates in clockwise direction. As shown in FIG. 1A with intake valve 1, (cam rotated 45 degrees) in opened position and exhaust valve 2 in closed position at radius Rc with its rise 25*e* and fall 26*e* cycle also rotated 45 degrees. These cams in their function and juxtaposition will be described later.

Figure 3D:
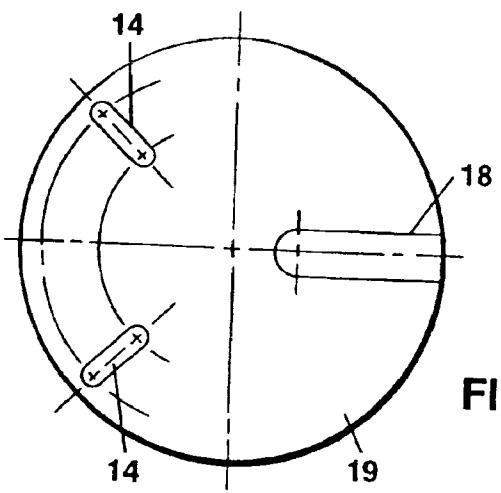
Figure 3B:
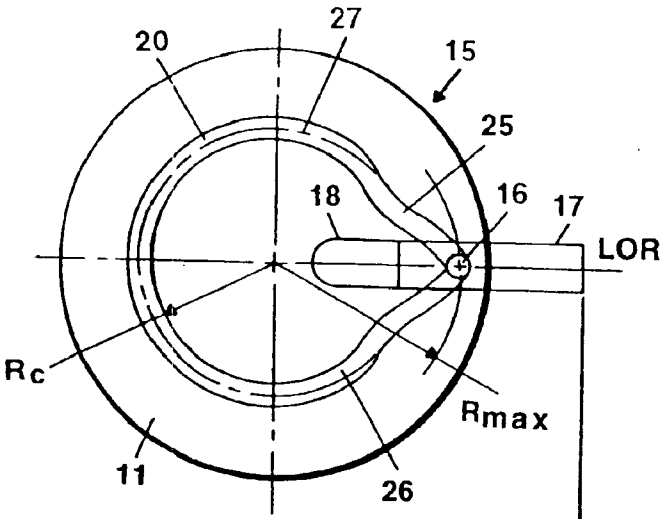
Figure 3A:
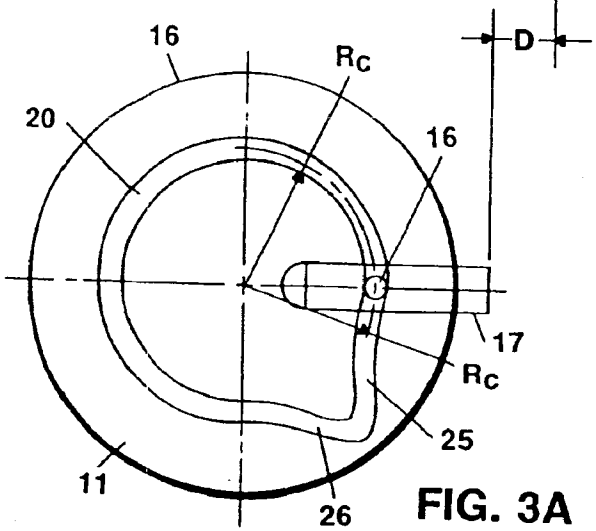
Figure 3E:
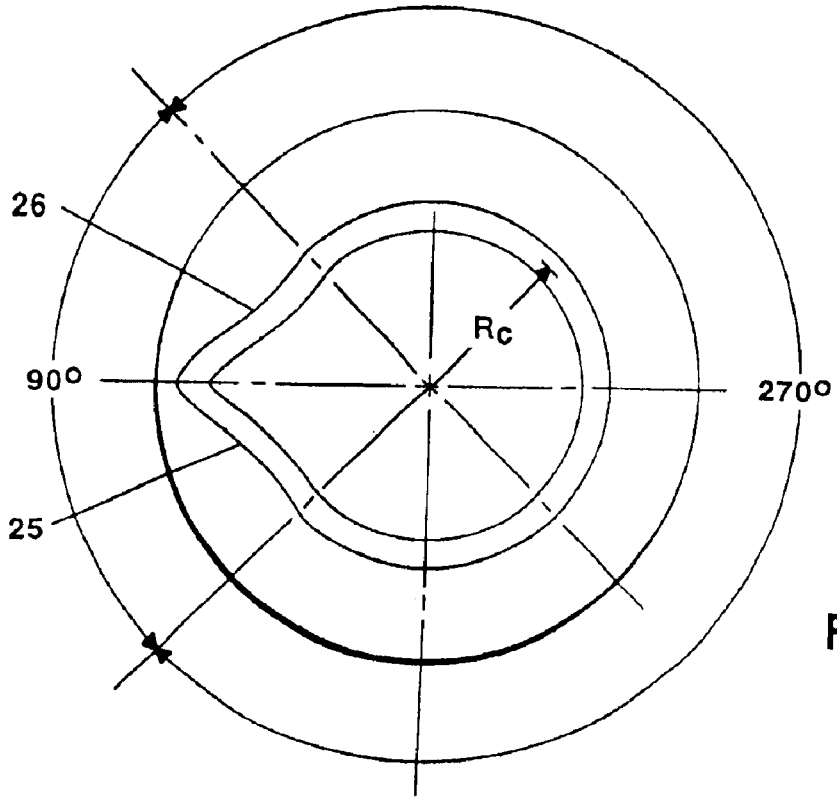
Figure 3F:
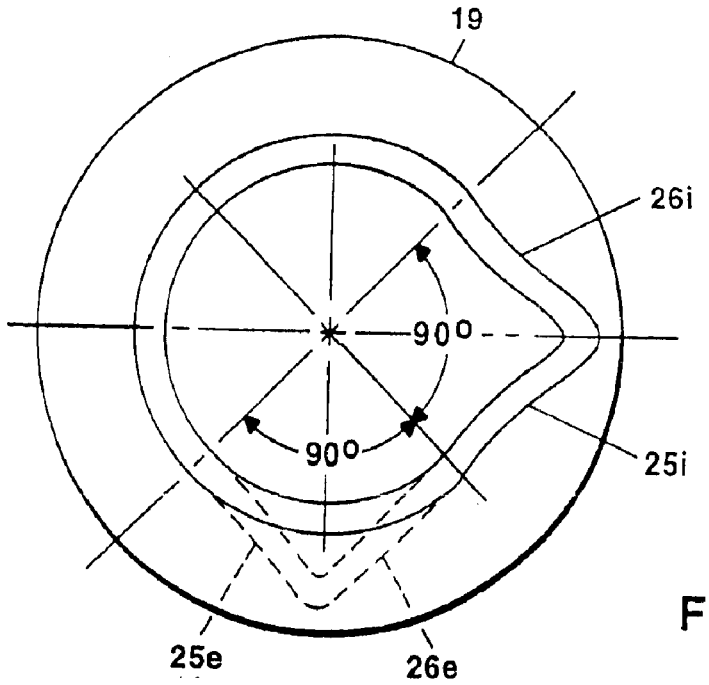

Alternate radial groove locations 14 shown in FIG. 3D are located in the backing plate 19 for the purpose of containing balls that will be used solely for stabilizing the plane of the rotating input cam. During rotation of the input cam these balls will merely reciprocate back and forth in these grooves 14. Also shown in the backing plate is the guideway 18 that guides the slide during its reciprocating motion.

Figure 4:
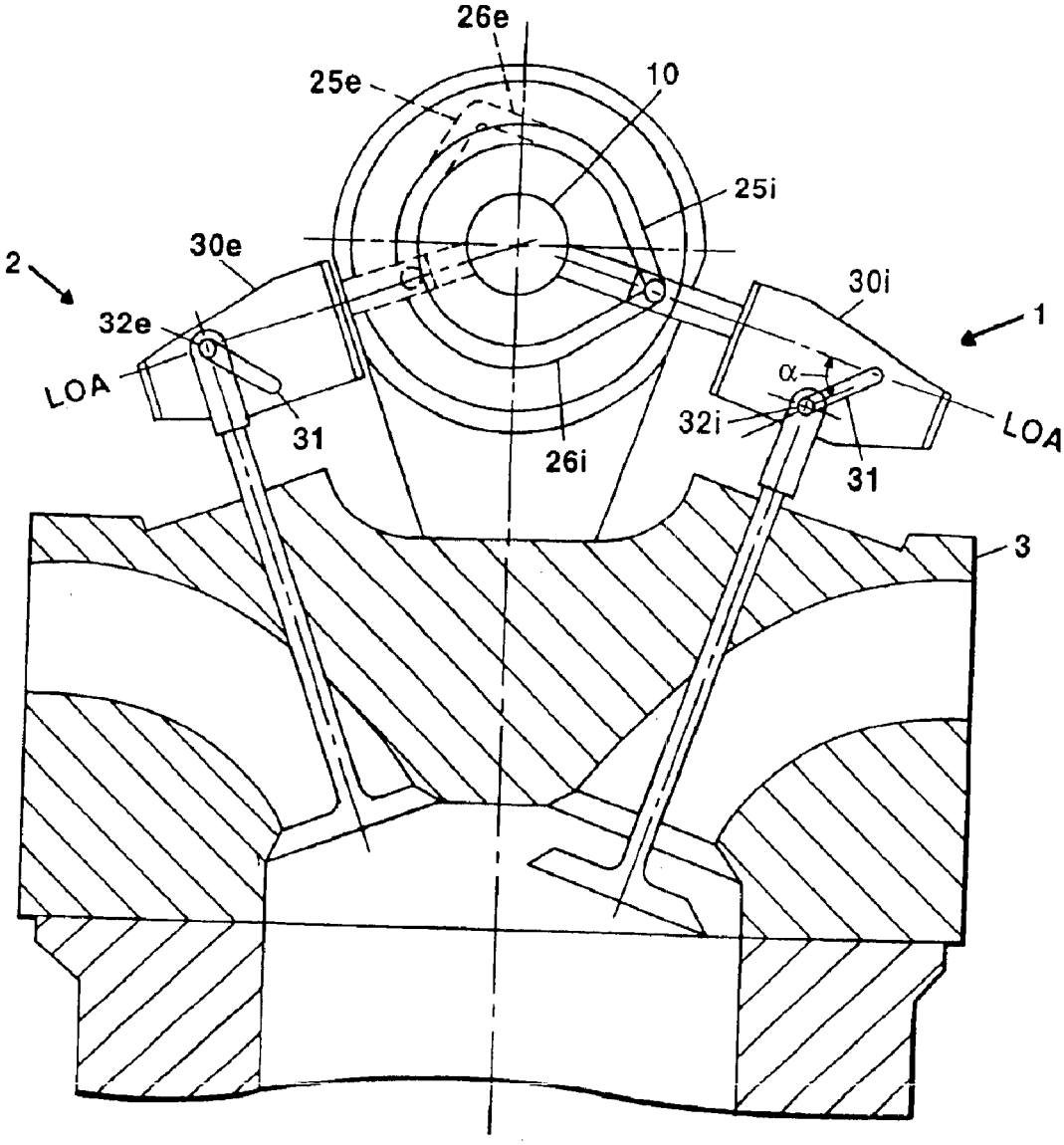
FIG. 4 represents a partial, cross-sectional view of the intake and exhaust valves of the valve system of this invention.

In FIG. 4 a basic configuration of the intake valve 1 and exhaust valve 2 are shown. As the camshaft 10 rotates in clockwise direction the cam assemblages 30*i* and 30*e* will slide along their respective lines of action and, in accordance with their rise and fall cycles, reciprocate back and forth and dwell in accordance with the slide. Slotted cam 31 at some angle $\alpha$ will reciprocate along the LOA in concert with the slide. In the slotted cam are pins 32*e* and 32*i* which extend from the valve stem are forced to travel in the slot and by virtue of the fact that the valve is captured in the cylinder head 3 and can only move up and down in the piston, the drive cam with its slotted angular cam track will force the pin down as the assemblage is displaced outwardly and, in turn, force the pin up as it returns to its initial position. Accordingly, as the camshaft rotates 90 degrees, the rise and fall cycles will displace the valve from a closed to an open to a closed condition. As the input cam continues to rotate the remaining 270 degrees, valve 2 will dwell and remain closed as shown in FIG. 4. In FIG. 4 the valve 1 is at its maximum 100% opened condition. This essentially springless kinematic action is a preferred embodiment of the present invention in that its minimal mass inertia and positive essentially springless control during actuation indicates an ability that can co-exist with higher engine speeds.

The configuration shown in FIG. 4 illustrates a valve actuation system with fixed displacement and is functional in the same capacity as the spring-cam system. Although the variable displacement feature of this invention has not yet been introduced the configuration represents substantial advantages over the spring-cam system in that considerable power savings are possible by eliminating the stored energy in the springs and the minimal mass inertia of the valve assembly will be accommodating to higher engine speeds.

Figures 5A, 5B, 5C, 5D, 5E, 5F:
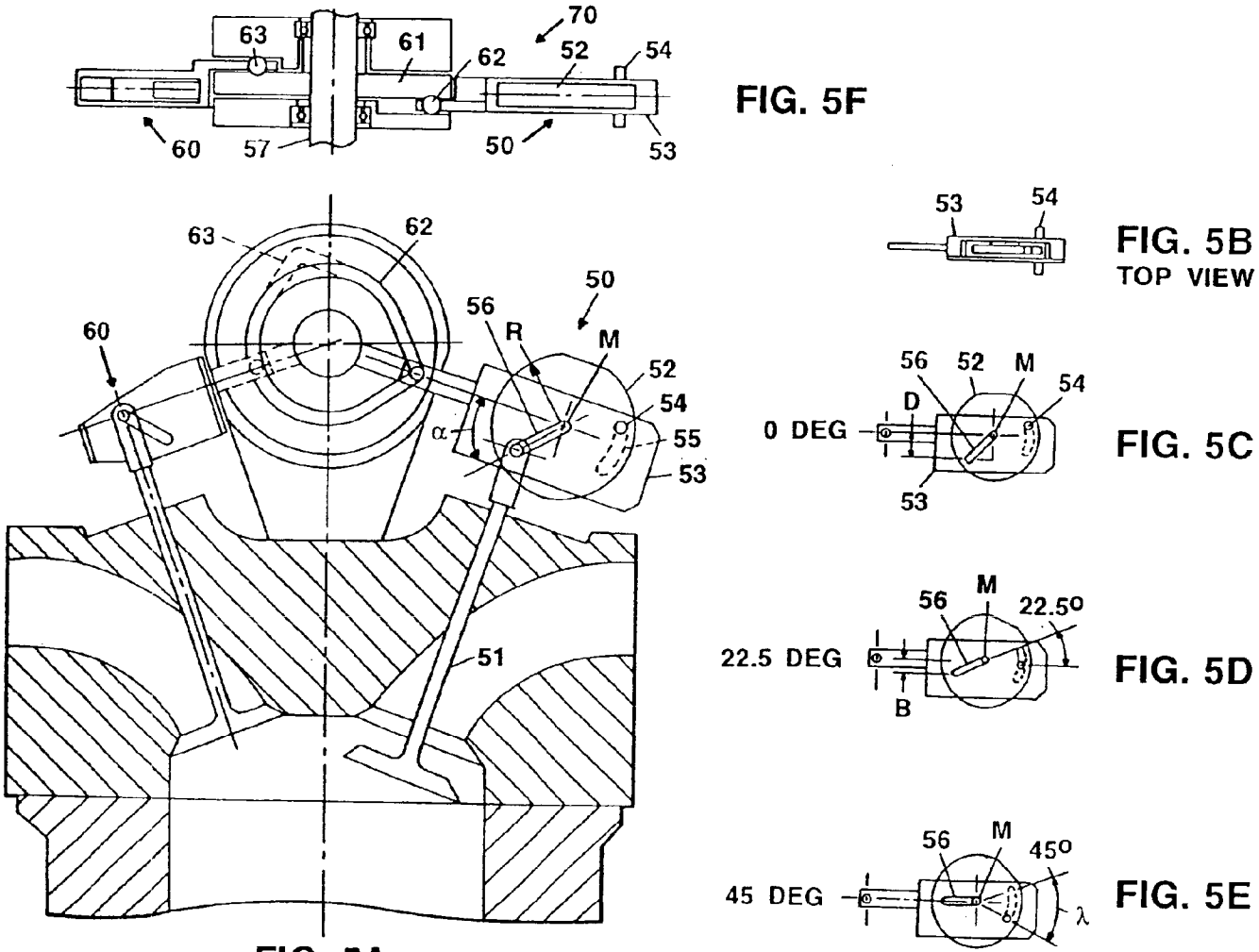
FIGS. 5A–5F illustrate the variable displacement features of the valve system of this invention, with FIGS. 5B–5D showing the invention with a portion removed.

FIG. 5A illustrates the variable displacement feature for valve actuation of the present invention. In the actuator system shown in FIG. 5A, the intake valve 50 illustrates the mechanism by which a valve stroke cannot only be incrementally adjustable to its full opening but can also be controlled to close the valveport indefinitely while the engine is running. The kinematics will be first described and the control features will follow. The exhaust valve 60 is not necessarily a controlled function and will not be included at this time, although a similar variable actuation system can be utilized therewith if desired.

The drive cam slot earlier described in FIG. 4 as a fixed angle is now included in the circular desk 52 in FIG. 5A and configured to be rotatable and preferably about point M, the center of the disk.

The rotation function as shown, although not limited to, comprises of a circular disk 52 of radius R that rotates in housing 53 containing a circular cavity also of radius R and a pin 54, FIG. 5B, that extends beyond the housing 53 and rotates in circular slot segment 55. Pin 54 is the means by which a control system, later described, can rotate the circular disk 52 any angular position within the angle $\alpha$. FIGS. 5C, 5D and 5E illustrate various rotational angles of the circular disk 52 and the resulting orientation of the slot 56. In FIG. 5C, the plunge of the valve 51 will be maximum and equal to D. FIG. 5E shows the circular disk slot 56 rotated the angle $\lambda$ so the slotted cam is horizontal and does not allow for any plunge of the valve 51 as the drive link slot is co-linear with the line of action of the reciprocating slide so there is no resultant downward displacement. FIG. 5D shows the circular disk slot rotated to an intermediate angle with the resulting downward motion B which is a fraction of the maximum excursion D. It can be seen that by rotating the circular disk link about M, adjustment of the valve 51 displacement is essentially infinitely variable from zero displacement to its maximum value D.

The center point M is critical in that it represents the closed position of the valve 51 and must be consistent and repeatable for any rotational angle of the circular drive disk as shown in 5C, 5D and 5E. Since the valve 51 must be closed for each cycle and since the variable aspect of valve displacement can be required at any time it follows that for the valve to close for each cycle, the pin 54 must achieve the position at M for each cycle. By maintaining point M at the same juxtaposition regardless of circular disk rotational angle this requirement is well met.

In the assembly 70 of FIG. 5F, intake and exhaust valve actuator systems 50 and 60, respectively, are shown as part of the preferred embodiment of the present invention. The intake variable valve actuation system 50 for the intake cycle was previously described in FIG. 5A and the exhaust valve actuation 60 was described in FIGS. 2A and 2B. The cam track or groove configurations which initiate the reciprocating motion of the slide are integral with the input cam 61 one on either face, groove or track 62 for the intake stroke and groove or track 63 for the exhaust stroke. As the input cam 61 rotates both assemblages, 50 intake and 60 exhaust will reciprocate at precisely the same rate in concert with the engine crankshaft 57 in accordance with cam grooves 62 intake and 63 exhaust.

FIGS. 6A–6J illustrate side and top views of the input cam sequencing in concert with the four cycle internal combustion engine and timed by the engine crankshaft. Other cycle engines can also be based upon this inventive concept as well.

Figure 6B:
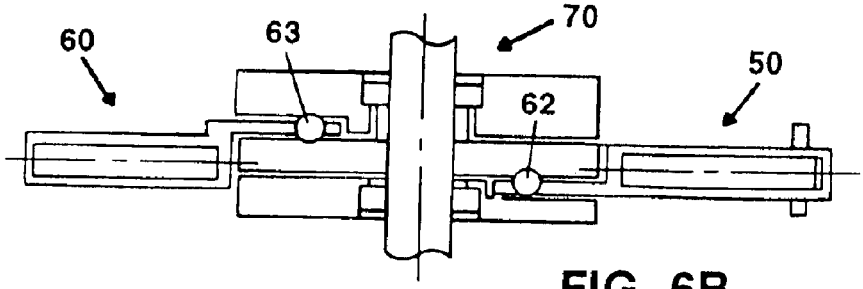
FIGS. 6A–6J illustrate various side and top views, respectively, moments in the movement of the valves within the system of this of this invention.
Figure 6A:
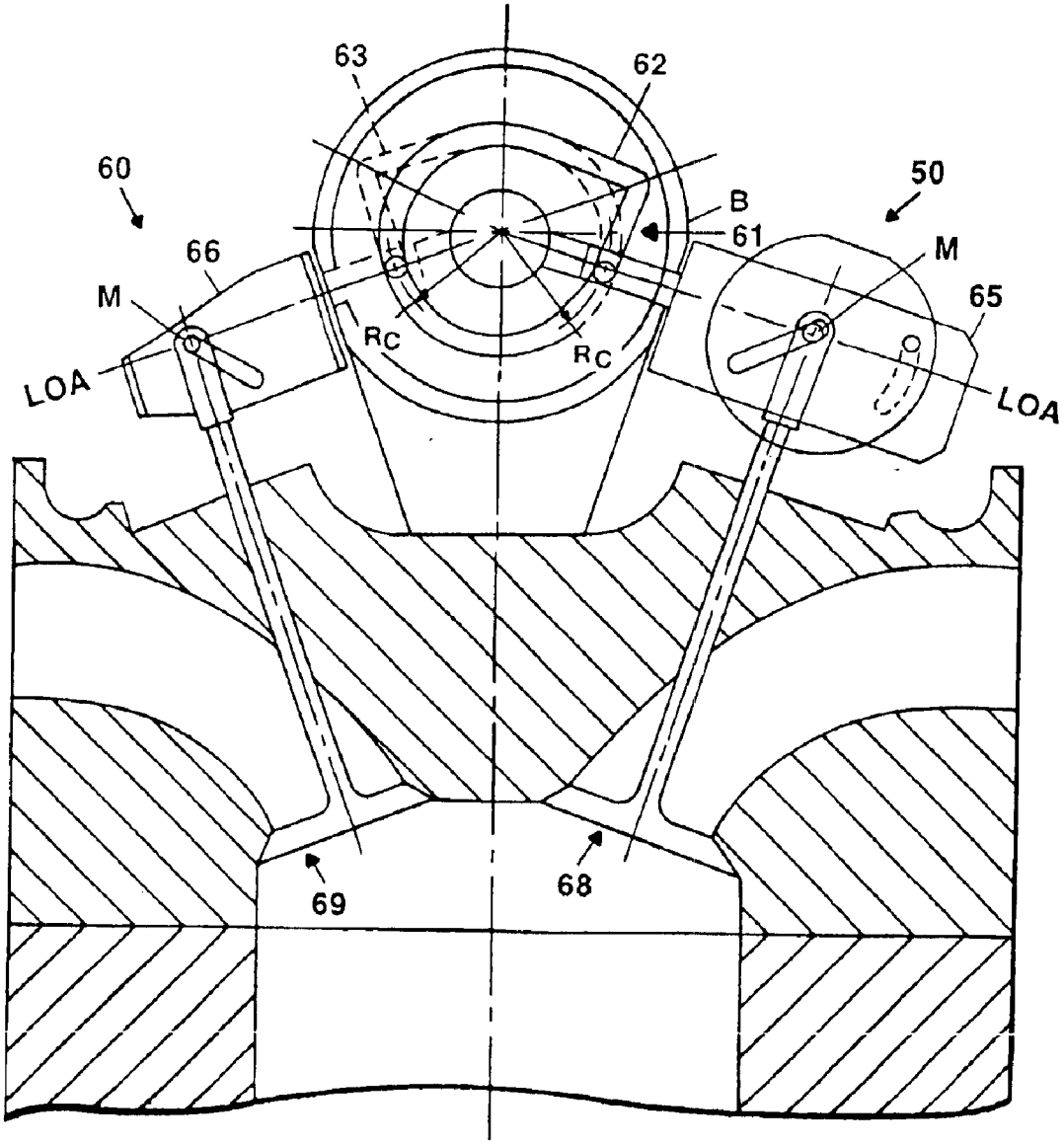
Figure 6D:
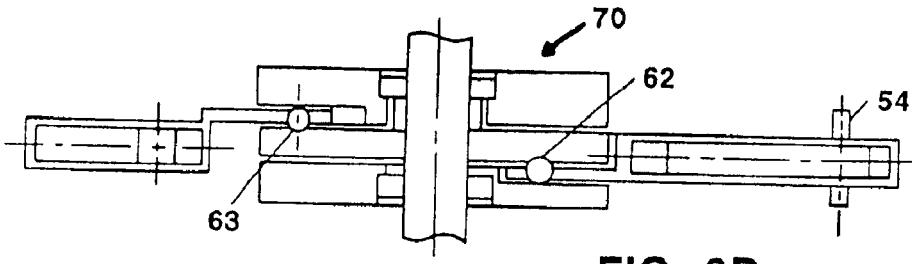
Figure 6C:
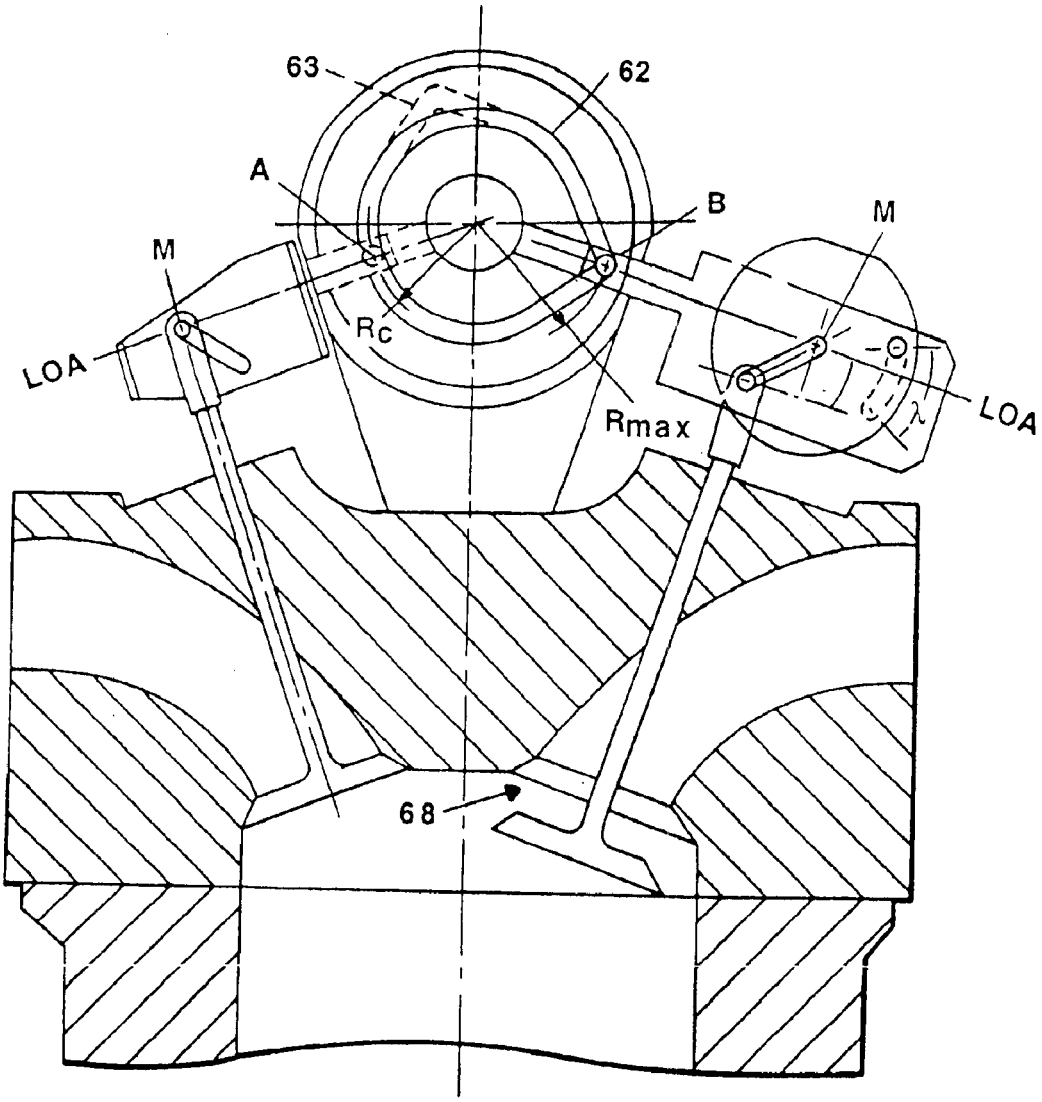

FIGS. 6A and 6B are snapshots of the moment when both the intake and exhaust valves 50 and 60, respectively, are closed and their cam tracks 62 and 63 are at the Rc radius as described in FIG. 4. The camshaft clockwise rotation at this moment reflects the just completed closure of the exhaust valve and the imminent opening of the intake valve. The valve stems are at point M, the closed position of the valve ports 68 intake and 69 exhaust. FIGS. 6C and 6D occur after 45 degrees of camshaft rotation and illustrates the maximum displacement Rmax of cam track 62 and full displacement of the slide at point B resulting in the complete opening of the intake valve 68 and maximum port opening since the circular drive disk slot is oriented at its angle $\lambda$ in accordance with FIG. 5C. This completes the intake cycle of the cylinder. In the meantime, the exhaust valve remains closed as its cam track 63 at point A still reflects the Rc radius and therefore maintains the valve in its closed position.

Figure 6F:
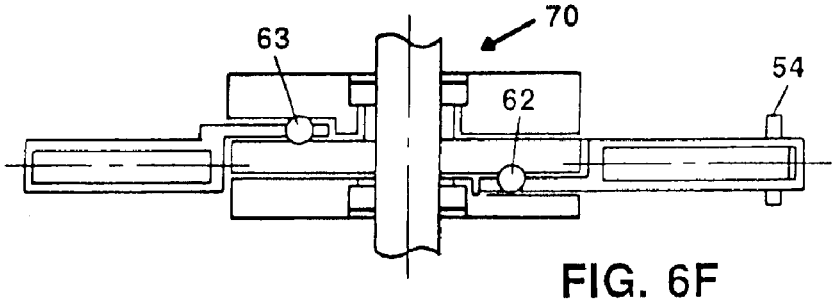
Figure 6E:
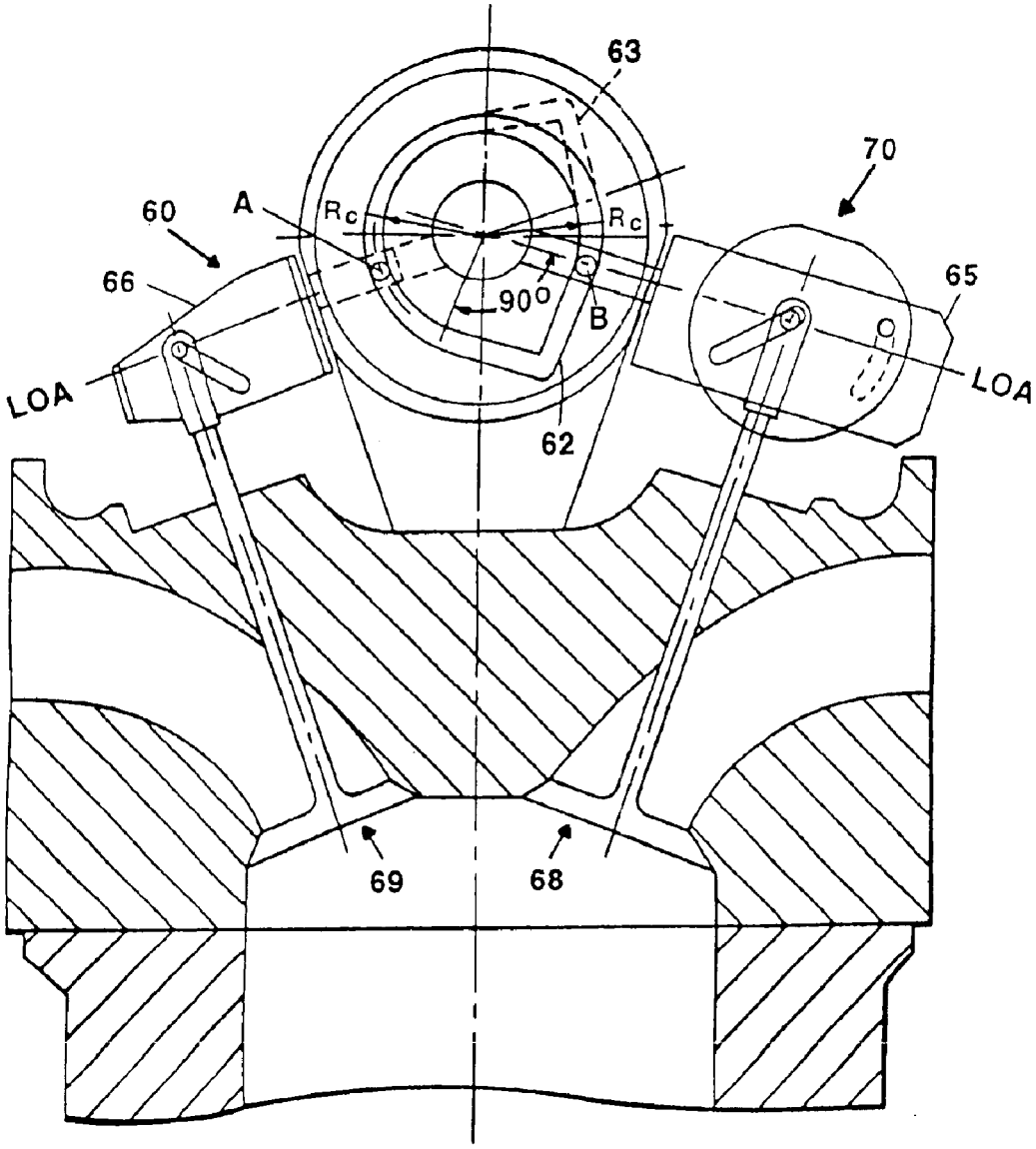
Figure 6H:
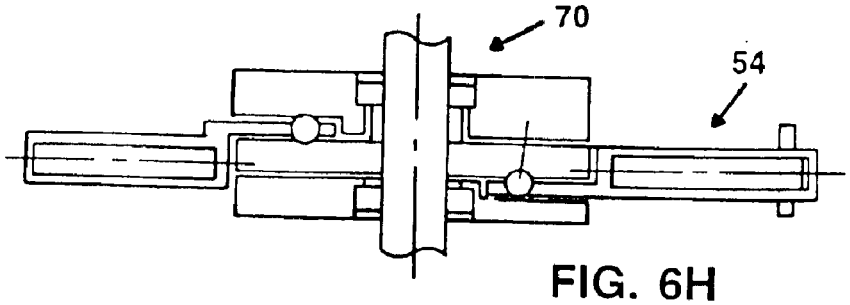
Figure 6G:
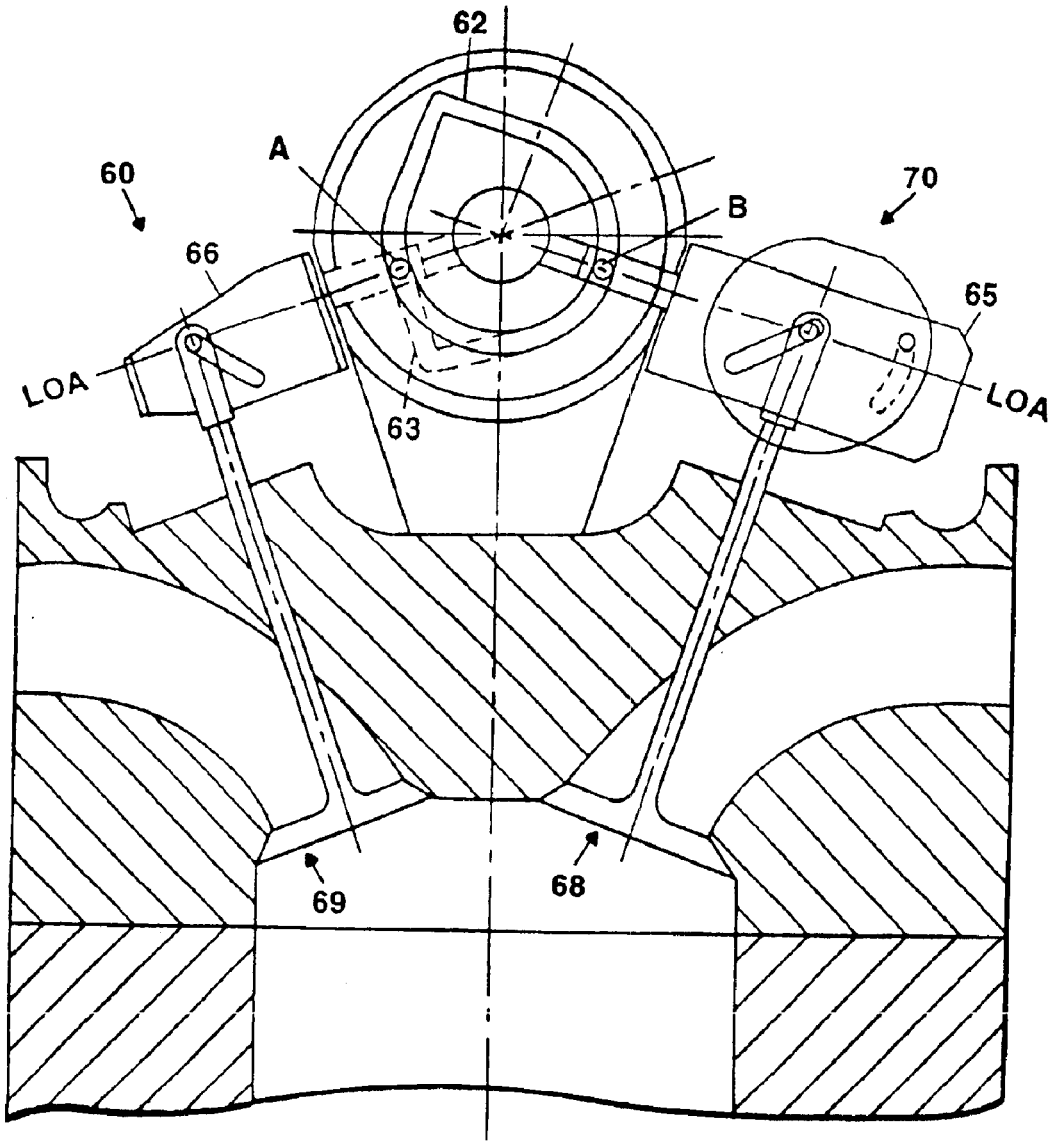
Figure 6J:
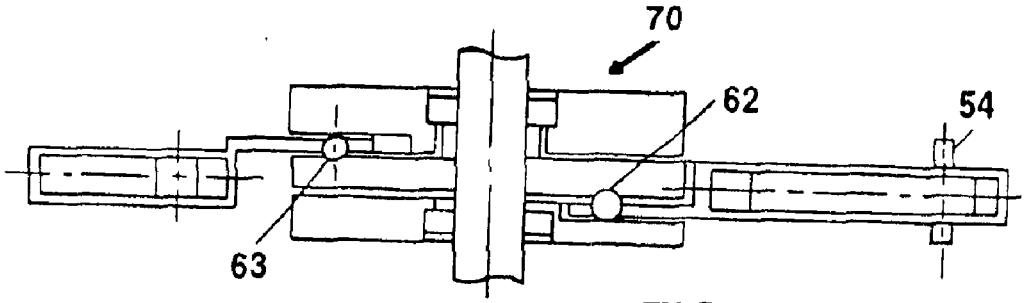
Figure 6I:
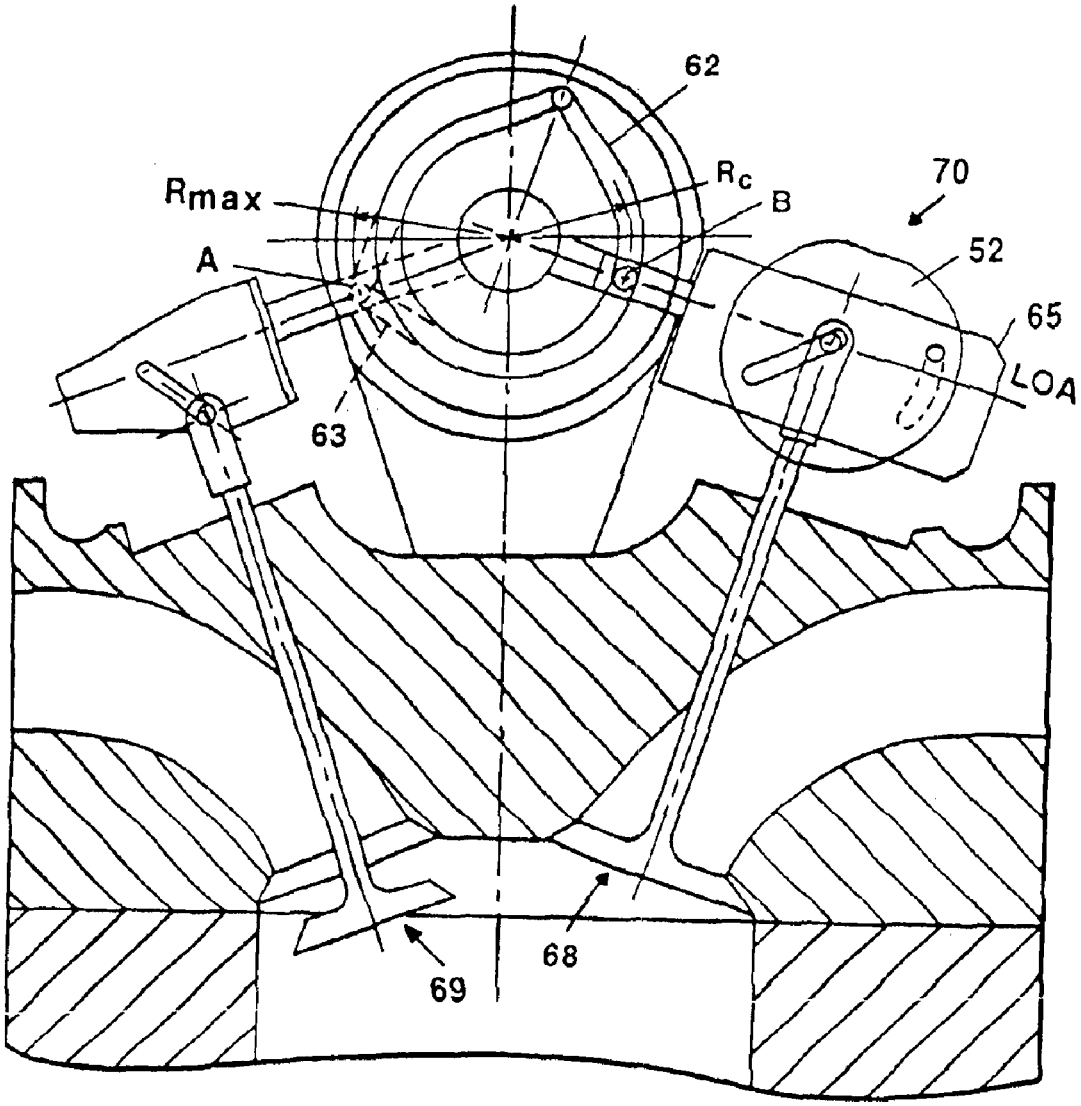

FIGS. 6E and 6F occurs 45 degrees later and at this instant Rc is reflected at points A and B which results in both cams 68 and 69 being closed. These valves will remain closed for the ensuing 180 degrees of camshaft rotation as both cam tracks 62 and 63 will present Rc at both points A and B. This is necessary to allow the piston to experience the compression and combustion cycles. Accordingly, the camshaft at the time has rotated a total of 270 degrees and the cam tracks have achieved their position shown in FIGS. 6G and 6H with exhaust cam track 62 ready to open the exhaust valve for the final 90 degrees at point A while the intake cam track 63 is at Rc at point A and remain at Rc for the final 90 degree rotation of the camshaft. FIGS. 6I and 6J reflect the opened exhaust valve 69 at 45 degree rotation of the camshaft from FIGS. 6*g* and 6H as dictated by cam track 63 at point A $R_{max}$ while the intake valve 68 remains closed as the intake cam track 62 is reflecting the Rc radius at point B. The exhaust port is constantly opened to its maximum port opening as shown, but can be adjusted by similar means as the intake valve if desired. An additional 45 degree rotation of the camshaft will close the exhaust port and complete the 4 stroke cycle of the engine. Its final configuration will be as shown in FIGS. 6A and 6B. It can be seen that the intake valve 68 opening can be adjusted by rotating the circular drive disk 52 in accordance with rotation of the camshaft just described. The valve displacement can be varied indiscriminately without affecting the piston cycling by having means of adjusting the circular drive disk cam slot can be achieved independently.

Figure 7:
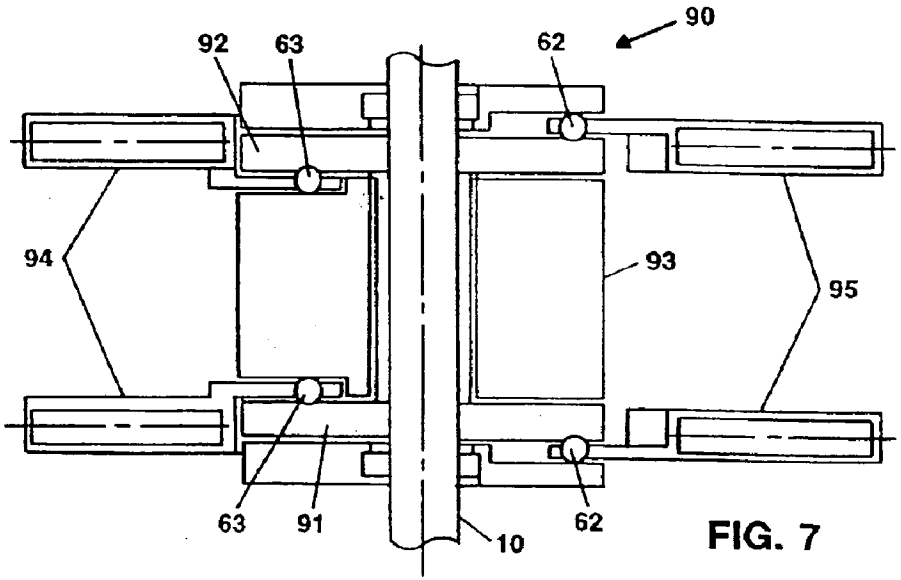
FIG. 7 represents a partial top view of two valve assemblies in a common housing of this invention.

The precise sequencing and timing requirements for the four cycle engine are well met with the cam sequencing assembly 70 (shown in top view), FIG. 6B as the two cam grooves 62 and 63 are precisely machined and phased in a single input cam. It can be seen that the assemblage 70 is a complete, robust and simple assembly which can control one intake and one exhaust valve. FIG. 7 illustrates how two of these assemblies in a common housing 90 can control two intake and two exhaust valves of a single cylinder. Engine designs in the overwhelming number of vehicles operate with four valves for more efficient operation. To describe the control function of these valves, the basic principal will be presented kinematically and then introduced into the four-valve assembly of FIG. 7 to complete this embodiment of the present invention. FIGS. 8A–8D illustrate the basic control function and is shown on a single intake valve.

The intake valve assembly 100 shows the valve as presented earlier, which includes the complete kinematic function in accordance with the preferred embodiments of this invention. It was shown how the valve actuation displacement can be incrementally varied by the circular disk (52) 101 drive slot 56 and slide assemblage 102. As demonstrated earlier, (FIG. 5A, pin 54), adjustment pin 103 is the component used to rotate the circular disk for varying the drive slot 56 angle $\alpha$ which in turn varies the stroke of the valve 108. As shown in FIG. 8A the angle $\alpha$ reflects maximum opening of valve 104. There are two principal constraints imposed on the pin 103. The first is the ability to rotate the pin for the desired valve opening and the second is to maintain the adjusted (closed) position while the valve is operational.

A control block 105 captures the pin 103 in slots 106 as it extends beyond the slide assembly 102. Slots 106 must be aligned and maintained parallel to the line of action LOA of the slide assembly 100. When a force P is applied to the control block 105, the downward displacement D, FIG. 8C, which must maintain the parallel juxtaposition of the slots 106 parallel to the LOA, and then the pin 103, which is captured in the circular slot segment 107, will rotate circular drive disk 101 any angle incrementally from 0 degrees to the angle $\lambda$. As the circular drive disk 101 rotates the pin 103 rotates in circular slot segment 107, it will require axial displacement in the slot 56 to accommodate the rotation. Constraint is required on the control block to assure the parallelism required of the slot 106 and the LOA. The kinematics are discussed here and a methodology will be presented later. When the desired angular position is achieved, the reciprocating motion of the slide assembly will also reciprocate the adjustment pin 103 at the same time. Slot 106 which is in the control block and parallel with the LOA will accommodate the action of adjustment pin 103 insuring its angular position relative to the angular position of the drive slot and in turn the desired displacement of the valve while the slide assembly is reciprocating. The control block is fixed relative to the valve assemblage 100 and insures the juxtaposition of circular drive disk from any loads applied to the valve and any dynamic noise impressed on the slide assemblage. FIG. 8B is a sectional view of the assemblage and shows the adjustment pin 103 in the slot 106 and the circular segment slot 107 of the slide housing 102.

FIG. 8C illustrates an auxiliary view of the assembly in the condition of maximum valve displacement at slot angle while FIG. 8D illustrates the circular disk at 0 degree position after application of load P to rotate the circular drive disk. The centerline connecting the two views illustrates the fixed position of the slide assemblage but shows the change of the circular disk 101, which is the difference between the flat 111 on the circular disk 101 and its radius R. The dotted position of the drive slot 110 which is the zero angle and no valve displacement is represented in FIG. 8D. It has been shown that the two conditions of restraint are well met by the control block 105 and demonstrates the required function of adjusting the intake valve displacement and maintaining the required displacement during the reciprocating motion of the slide assemblage and the proper sequencing cycle of the intake valve.

Figure 9B:
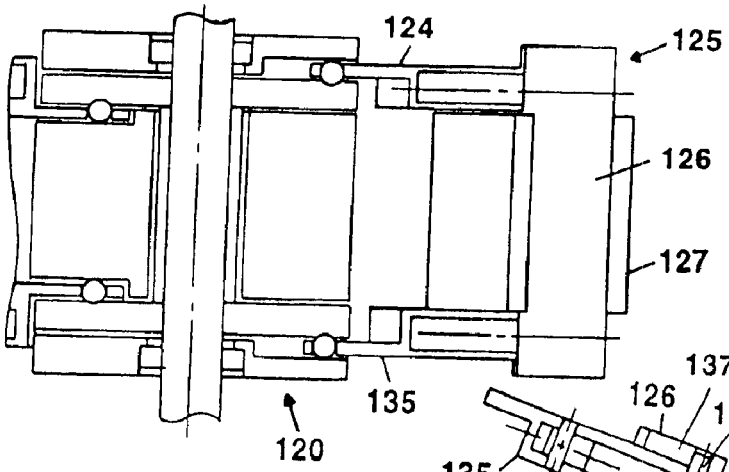
FIGS. 9A–9D illustrate the methodology utilized with the valve assemblies of this invention.
Figure 9C:
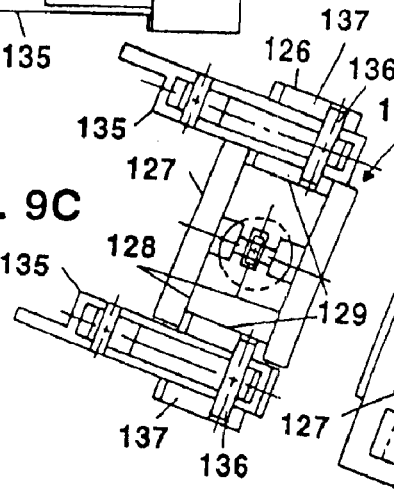
Figure 9D:
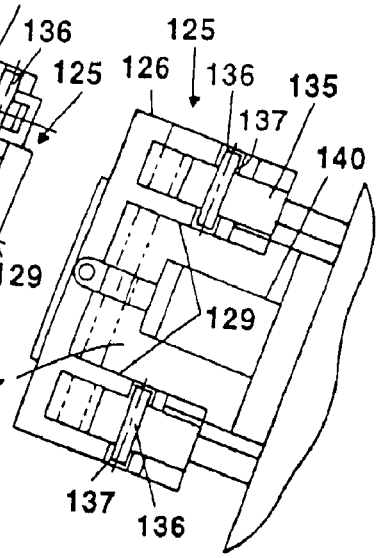
Figure 9A:
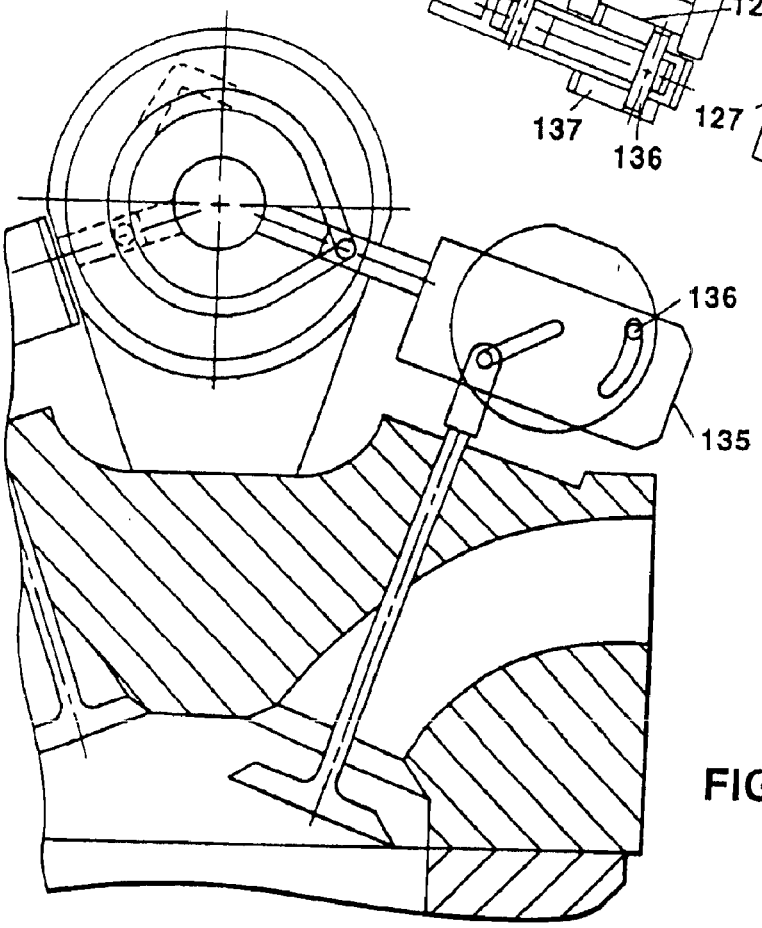

FIGS. 9A–9D illustrate, but are not limited to, a methodology which can be used with all the preferred embodiments of the present invention. FIG. 9B is a top view of a four valve cylinder; 9C is a cutaway top view and FIG. 9D is an auxiliary side view cutaway section. The four-valve assembly 120 as described in FIG. 7 is integrated with a control assembly 125 and integrated with intake valve assembly 135 as described in FIG. 5A. The control assembly 125 will demonstrate the control function described in FIG. 9A and as it will apply to a four valve cylinder of an internal combustion engine or any internal combustion engine regardless of the number of valves in its cylinders. The two intake valve slide assemblies 135 as shown in FIGS. 9B, 9C and 9D will be controlled by the control block assembly 125. As shown in 9C and 9D the adjustment pins 136 of both intake slide assemblies are captured in the control block slots 137. The control block is captured in the guideway housing 127. The block assembly is constrained in lateral and axial directions at 128 interface for axial motion and 129 interface for lateral motion. These interfaces are so disposed as to insure a vertical up and down motion of the control block that maintains the juxtaposition of the slot 137 parallel to the line of action of the reciprocating intake valve assembly 135. The control block when acted upon by an actuator, such as, but not limited to, a hydraulic cylinder 140, the centerline of which is so disposed as to be parallel with the valve, the control block can be incrementally displaced to produce the desired valve opening characteristic. Of course, it will be necessary to control the cylinder displacement and lock it in the desired position with suitable valving techniques. Accordingly, for a four-valve cylinder with two intake valves, yet another preferred embodiment of the present invention is the control aspects for varying the valve actuation.

It can be seen that, for example, in a six-cylinder engine with six such assemblies, that with a central control system that has position information of the hydraulic cylinders, it is possible to control gasoline intake for all cylinders individually or altogether and to control them as the engine is operating. Further, for 6 cylinder engines, six assemblies shown in FIG. 9A would be quite effective as only a single camshaft on each side of a V6 engine is required rather than the four camshafts, two intake and two exhaust, as required in the cam/spring valve actuation systems in present day automobile engines. Alignment between these shafts and timing is very critical and complicated as compared to the simple 6 assemblages of FIG. 9A and a single crankshaft. Timing in each piston is self contained, precise, repeatable and easily aligned. The valve actuation systems described above utilizes the same actuation assemblage for each cylinders with four valve and only requires adjusting each actuator in accordance with the firing sequence. The prior art spring-cam system presently in use not only requires the sensitive alignment and timing of the four camshafts but the installation of 24 springs all preloaded to produce 65 to 80 pounds of force. Finally, the elimination of power required to overcome these preloads and accelerate the valve mass inertia will be significant and contribute a more efficient delivery of power for each gallon of gasoline. The present invention without springs (desmodromic) and less mass inertia along with variable valve displacement, will offer a significant increase in performance for an internal combustion engine. The simple, robust actuation system of the present invention is not only more advantageous in performance but is more easily manufactured, assembled and installed over the cam-spring system presently installed in automobiles today.

Figure 10:
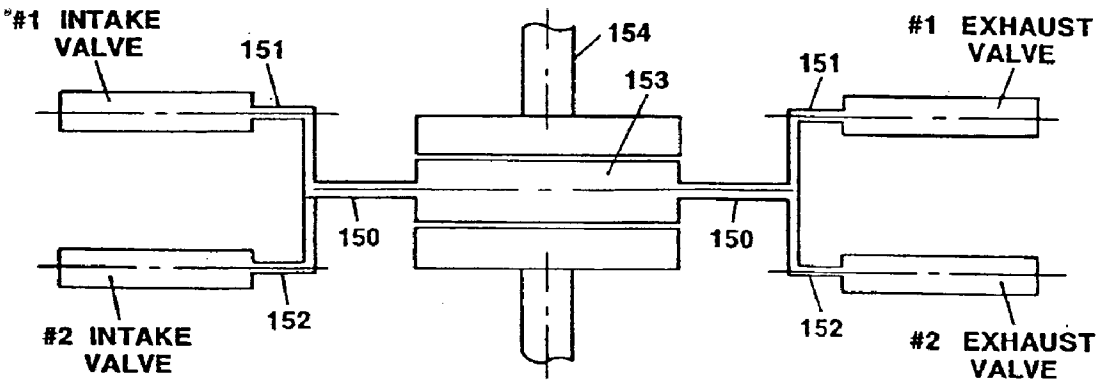
FIG. 10 is a schematic representation of a further embodiment of the invention representing multiple valves per cylinder.

As shown in FIGS. 1–9, the valve configuration of an intake and exhaust valve mechanism is for a cylinder having two valves. There are engines with multiple valves per cylinder and include four and six valves per cylinder. As shown in FIG. 10, it is possible to include multiple valve actuation from the same drive link of the single valve mechanism. The drive 150 of this embodiment of the invention becomes a multi-fingered drive link with two drive links 151 and 152 with associated driving (actualting) mechanisms for each valve. Duplicate actuating mechanisms will be required for the four valves as shown. Accordingly, a single cam 153 on camshaft 154 controls four valves as shown, as for example, with the case of six valve cylinders.

The thermodynamic combustion that occurs in either a gasoline or diesel engine results in the release of extremely high heat energy that must be absorbed in the cylinders of the engine block and cylinder head. Heat transfer is accomplished by coolant water flowing through the engine assembly. This effusion of heat energy directly affects the valves and their ineffectiveness in conducting or radiating the absorbed heat results in extremely high temperature rise of the valves, over 500° f.

The result of these elevated temperatures, for example, is an elongation of the valve stem 33 (illustrated in FIGS. 2A and 2B without thermal elongation). An elongated valve stem may cause the valve to not sufficiently seat resulting in poor engine performance as well as permit dangerous gas vapors to escape and precipitate an explosive environment. Accordingly, accommodating the variation of valve stem length is another embodiment of the present invention and is shown in FIGS. 11A–11C.

As shown in FIG. 2A, the configuration of slot 31 and the nominal position of the valve stem pin 32, the valve is closed. In this juxtaposition, the valve will always close but the thermal growth of the valve may prevent the valve from properly seating. An alternative embodiment of the present invention introduces a valve stem thermal compensator 175 into the slot 31 to accommodate, for example, the extended valve stem 33 and achieve substantially full valve closure or seating and is illustrated in FIGS. 11A–11C.

Figure 11A:
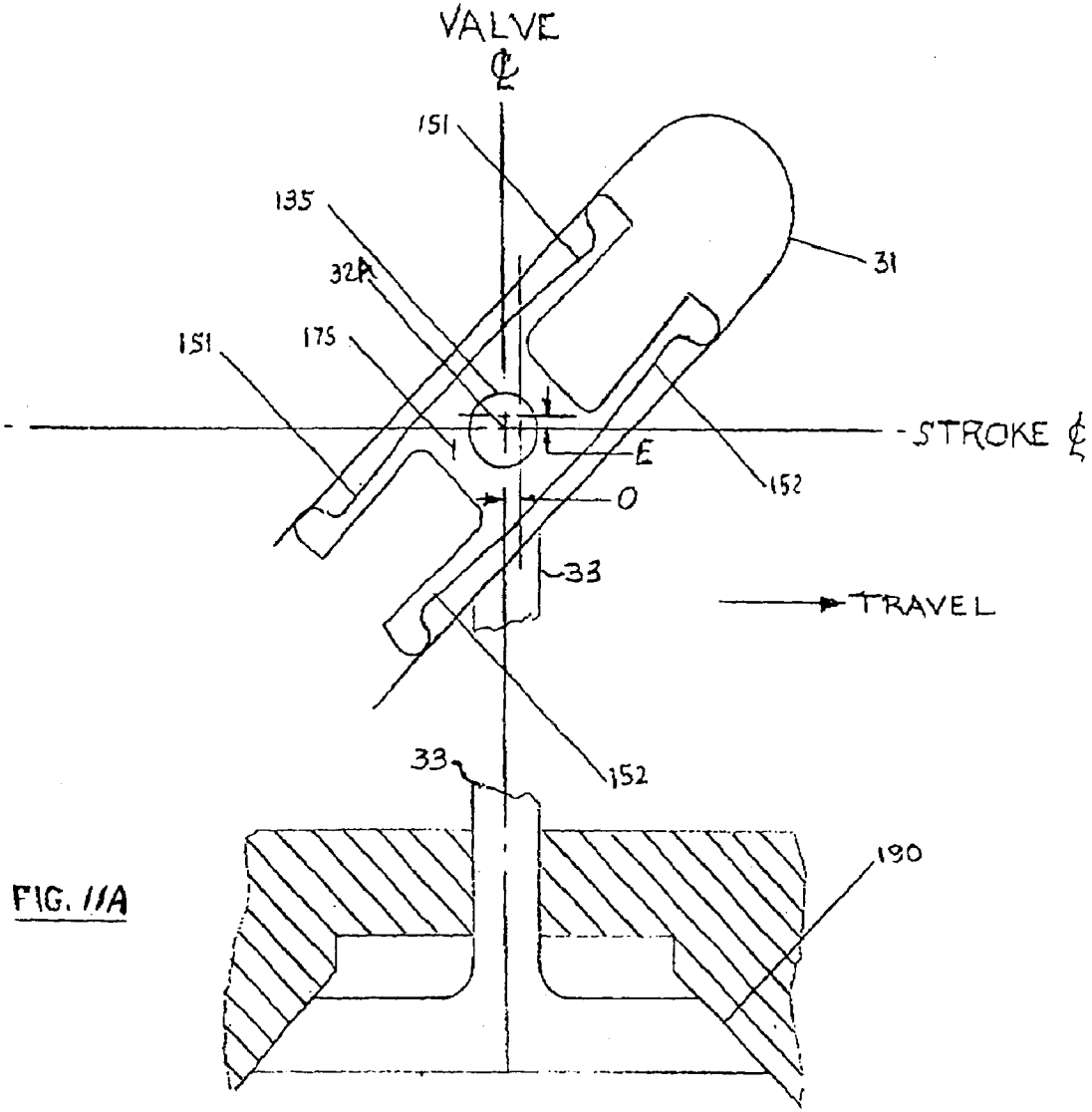
FIGS. 11A–C are schematic representations of a further embodiment of the invention illustrating a valve stem thermal expansion and contraction compensator.

As illustrated in FIG. 11A, the theoretical center of the valve stem pin hole 32A is the normal location of the valve 190 at closing. The valve stem thermal compensator 175 contains the valve stem pin hole 32A and pair of distally opposed spring-like projections 151 and 152. The extended length E is the position required of the valve stem pin 32 at its maximum temperature. The travel T requires an overdrive position denoted by 0 to achieve the proper slot position and achieve closure of the valve 190. The pair of distally opposed spring-like projections 151, 152 have predetermined spring constants, deflections, and damping characteristics to sufficiently seat the valve 190 under operating conditions without inducing an excitation mode that could cause the valve 190 to bounce. The pair of distally opposed spring-like projections 151, 152 are pre-loaded in the slot 31 such that the pair of distally opposed spring-like projections 151, 152 are always under a load and asserting a force on to the slot 31, whereby the valve stem thermal compensator 175 maintains a tight fit within the slot 31 during all operational and ambient conditions.

Figures 11B, 11C:
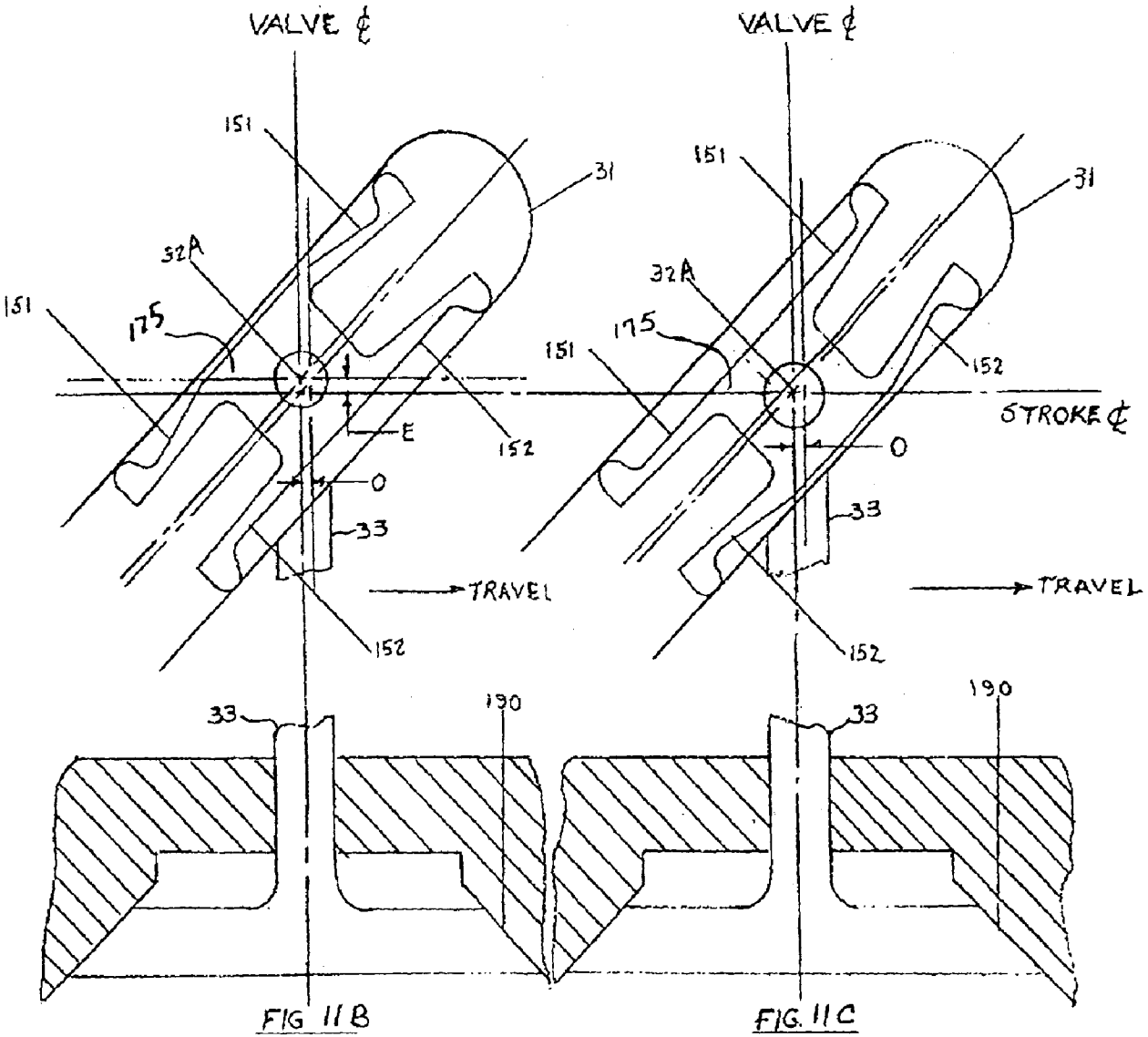

FIGS. 11B and 11C illustrate the two extreme conditions of valve 190 closure. FIG. 11B illustrates the condition of the pair of distally opposed spring-like projections 151, 152 for the heated extended valve stem 33. The travel T of the assemblage 35 (shown in FIG. 2A) overstroke the theoretical center of the valve stem pin 32 until the slot 31 arrives at the position that accommodates the extended length E, along the valve centerline, and thus sufficiently seating valve 190. The spring-like projections 151 deflect to accommodate the additional travel T required of the valve stem 33 to seat the valve 190. The overstroke 0 is sufficiently long enough to provide for the alternative position of the slot 31.

FIG. 11C illustrates the condition of the crosshead member 175 at ambient temperatures. The travel T is constant for all conditions and must be accommodated at all times so that the camshaft 10 (FIG. 2A) is not affected. The closure of the valve 190 with its shorter valve stems requires deflection of the spring-like projections 152 to allow the overstroke to occur so that the camshaft 10 (FIG. 2A) and cam 11 (FIG. 3A) continue to rotate. Spring-like projections 151 are under a load due to the preload at assembly.

Accordingly, any condition between the two extremes can be accommodated and achieve sufficient valve 190 closure. The above compliant crosshead methodology for accommodating variable valve stem 33 lengths is presented to indicate the understanding of this critical situation and does not necessarily limit the invention to its adaptation but merely demonstrates one possible solution.

Although the invention has been described with respect to various embodiments, it should be realized this invention is also capable of a wide variety of further and other embodiments within the spirit and scope of the appended claims.

What is claimed is:

1. A thermal compensating desmodromic valve actuation system for opening and closing at least one valve of an engine, said system comprising:

a cam assemblage, said cam assemblage including a cam mechanism for rotational movement;

a driving mechanism for reciprocal movement operably connected to said cam mechanism;

said driving mechanism also being operably connected to the at least one valve of the engine to move the at least one valve between a valve closed position and a valve open position and between said open position and said closed position in a manner directly related to said rotational movement of said cam mechanism;

means operably connected to said driving mechanism for adjustably controlling the movement of the at least one valve in order to provide a variable amount of opening of the at least one valve in said open position;

said adjustably controlling means further comprises an adjustable rotatable disk operably connected to said driving mechanism;

said adjustable rotatable disk having an elongated slot therein, said elongated slot having a predetermined length which effects a maximum amount of opening of the at least one valve said elongated slot being disposed at an adjustable angle with respect to the center of the rotatable disk, said angle effecting the variable amount of said open position of the at least one valve; and a valve stem thermal compensator disposed in said elongated slot, said valve stem thermal compensator having a pair of distally opposed spring-like projections to maintain a pre-load therebetween, whereby, the at least one valve being moved between said closed position and said open position and between said open position and said closed position without the intervention of any spring action.

2. The desmodromic valve actuation system as defined in claim 1 wherein:

said cam mechanism comprises a cam disk for said rotational movement about a shaft, said cam disk containing a preselectively configured grooved cam;

said driving mechanism comprises a drive link and a drive member, said drive link operably connected to said grooved cam;

said grooved cam having a first portion capable of displacing said drive link outwardly and inwardly such as to initiate a sequence of mechanical motions of said drive member to cause opening and closing of the at least one valve, and said grooved cam having a second portion that provides a dwell for said driving member so as to maintain the valve in said closed position for a predetermined period of time.

3. The desmodromic valve actuation system as defined in claim 1 wherein the at least one valve includes a valve stem; and the valve actuation system further comprising means associated with said valve stem for connecting said valve stem to said elongated slot.

4. The desmodromic valve actuation system as defined in claim 3 wherein:

said connecting means comprises a drive pin operably connected with said elongated slot of said adjustable rotatable disk.

5. The desmodromic valve actuation system as defined in claim 4 wherein:

said elongated slot emanates from said rotatable disk center an appropriate length in accordance to said maximum amount of valve opening;

said elongated slot being disposed so as to create an angle with a line of action of said drive link, said angle referred to as an angle of attack;

said angle of attack effecting a linear displacement of said valve stem in a direction perpendicular to said line of action thereby resulting in opening of the at least one valve for the outward displacement of said driving mechanism via said drive link and closing of the at least one valve for the inward displacement of the driving mechanism via said drive link.

6. The desmodromic valve actuation system as defined in claim 5 wherein:

said angle of attack can vary from 0 degrees with no valve displacement and the at least one valve remaining in said closed position to a maximum angle of attack for maximum valve opening;

whereby said angle of attack with appropriate control can establish a substantially infinite variation in said angle of attack thereby providing substantially infinite variable valve openings.

7. The desmodromic valve actuation system as defined in claim 5 wherein:

the center of said rotatable disk is coincident with the line of action at all angles of attack as well as coincident with the centerline of said elongated slot such that if the at least one valve is to be maintained in said closed position the line of action of said drive link, the center of rotation of said rotatable disk and the centerline of said elongated slot are all coincident.

8. The desmodromic valve actuation system as defined in claim 5 further comprising means operably connected to said rotatable disk to control the angle of attack of said elongated slot.

9. The desmodromic valve actuation system as defined in claim 1 further comprising means operably connected to said rotatable disk to control the angle of attack of said elongated slot.

* * * * *

UNITED STATES PATENT AND TRADEMARK OFFICE

CERTIFICATE OF CORRECTION

PATENT NO. : 6,953,014 B2
DATED : October 11, 2005
INVENTOR(S) : Frank A. Folino It is certified that error appears in the above-identified patent and that said Letters Patent is hereby corrected as shown below:

Column 12,
Line 49, "the at least one valve said elongated slot" should read -- the at least one valve, said elongated slot --.

Signed and Sealed this

Sixth Day of December, 2005

JON W. DUDAS
*Director of the United States Patent and Trademark Office*